US006857227B2

(12) United States Patent
Russell

(10) Patent No.: US 6,857,227 B2
(45) Date of Patent: Feb. 22, 2005

(54) VEHICLE CRASH BARRIER

(75) Inventor: Larry R. Russell, Houston, TX (US)

(73) Assignee: Automatic Power, Inc., Houston, TX (US)

( * ) Notice: Subject to any disclaimer, the term of this patent is extended or adjusted under 35 U.S.C. 154(b) by 0 days.

(21) Appl. No.: 10/375,795

(22) Filed: Feb. 26, 2003

(65) Prior Publication Data

US 2003/0159356 A1 Aug. 28, 2003

Related U.S. Application Data

(60) Provisional application No. 60/360,438, filed on Feb. 28, 2002.

(51) Int. Cl.[7] ..... E01F 13/00
(52) U.S. Cl. ..... 49/49
(58) Field of Search ..... 49/13, 49, 9, 226, 49/227; 404/6, 9

(56) References Cited

U.S. PATENT DOCUMENTS

| | | | | |
|---|---|---|---|---|
| 1,296,658 | A | 3/1919 | Hansen | |
| 1,628,651 | A | 5/1927 | Burress | |
| 1,709,344 | A | 4/1929 | Gage | |
| 1,848,517 | A | 3/1932 | Davison | |
| 2,324,726 | A | 7/1943 | Sawyer | 39/1 |
| 4,844,653 | A | 7/1989 | Dickinson | 404/6 |
| 4,989,835 | A | 2/1991 | Hirsh | 256/13.1 |
| 6,009,670 | A * | 1/2000 | Howard | 49/340 |
| 6,115,963 | A | 9/2000 | Allardyce et al. | 49/49 |
| 6,289,634 | B1 | 9/2001 | Allardyce et al. | 49/49 |
| 6,370,821 | B1 | 4/2002 | McCord et al. | 49/34 |

* cited by examiner

*Primary Examiner*—Jerry Redman
(74) *Attorney, Agent, or Firm*—Elizabeth R. Hall

(57) ABSTRACT

The present invention is a pivoting crash barrier for arresting an impacting vehicle without causing excessive injury to the driver. The crash barrier has an easily replaceable expendable gate which houses multiple plastically deformable cables mounted within for absorbing the energy of the impacting vehicle. The crash barrier design causes the cables to deform as an unit, rather than separately. The crash barrier gate is pivotally supported on a horizontal shaft by an operator unit positioned on a first side of a roadway. An engagement stanchion engageable by the outer tip of the lowered gate supports the lowered gate on the second, opposed side of the roadway. The upper sections of both crash barrier stanchions consist of operator heads that can pivot about the vertical axes of their respective mounting posts after the shearing of restraining shear pins whenever a vehicle impact occurs. This swiveling reduces the tendency for the components of the crash barrier other than the gate to sustain significant damage during vehicle impacts. The crash barrier gate further has a latch on the engagement stanchion side that prevents inadvertent gate unlatching from uplift forces to the gate and a simplified method of balancing the crash barrier with counterweights.

49 Claims, 27 Drawing Sheets

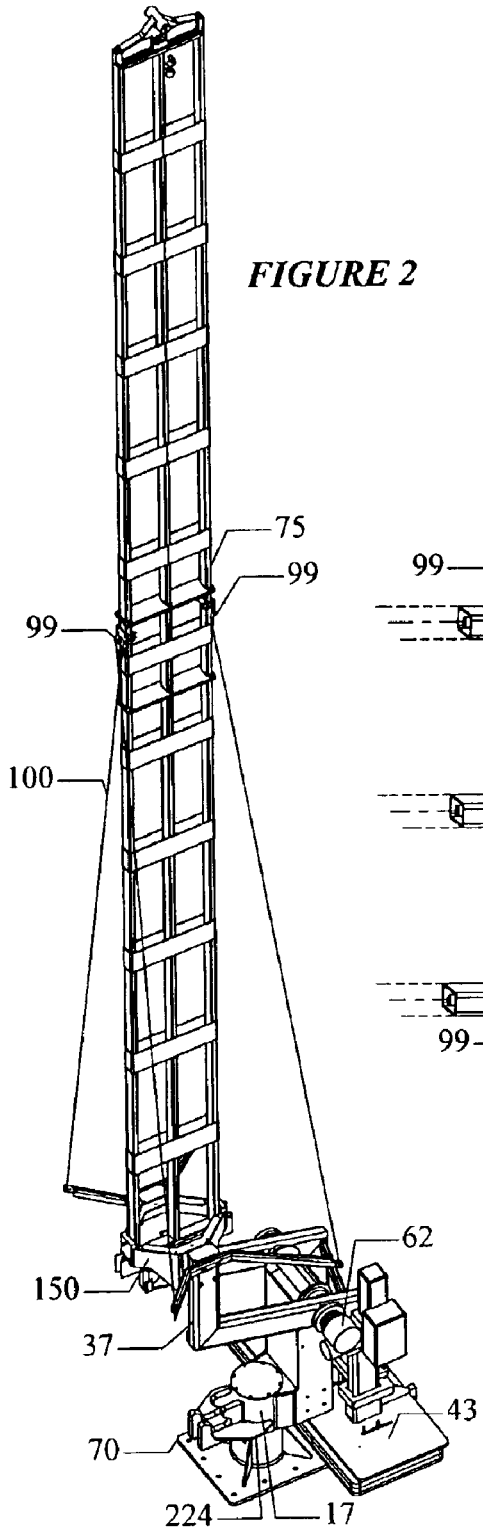
*FIGURE 2*
*FIGURE 36*
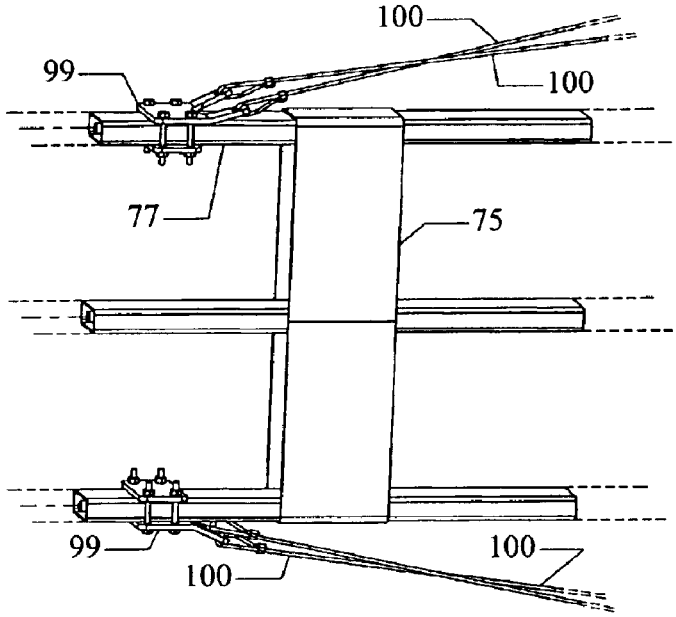

FIGURE 3
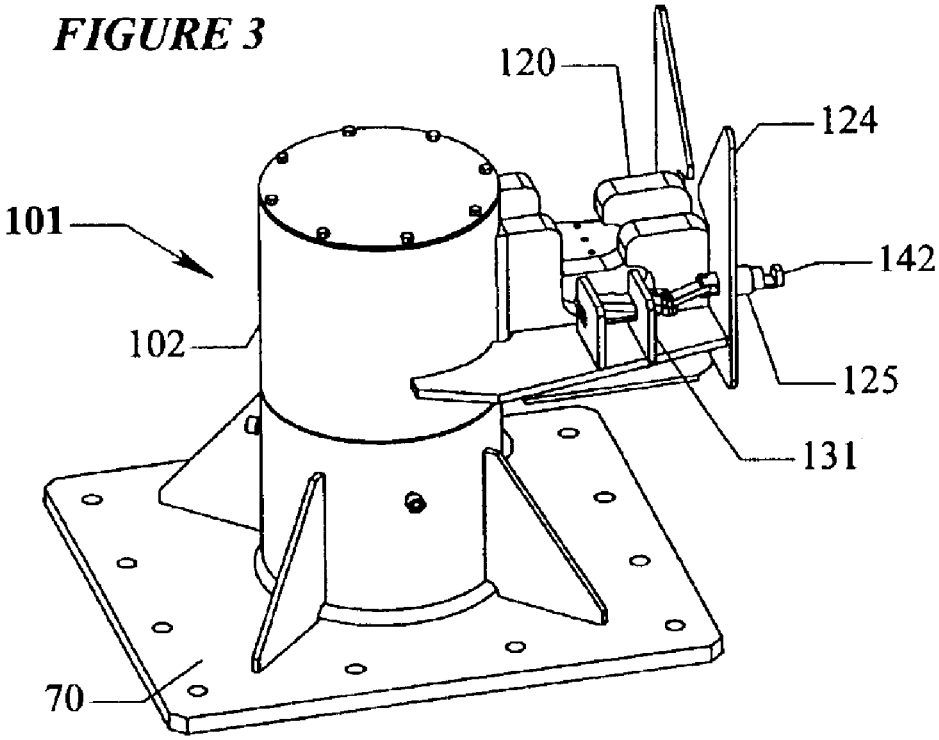
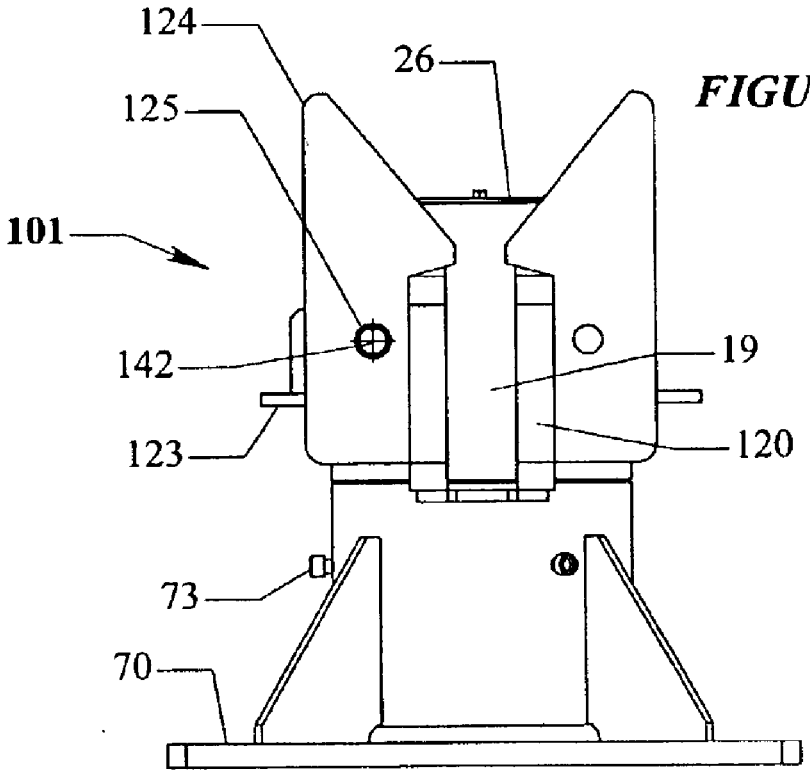
FIGURE 9

VEHICLE CRASH BARRIER

CROSS REFERENCE TO RELATED APPLICATIONS

This application claims priority to pending U.S. patent application Ser. No. 60/360,438, filed Feb. 28, 2002 by inventor Larry R. Russell and entitled "Vehicle Crash Barrier."

BACKGROUND OF THE INVENTION

1. Field of the Invention

The present invention is directed to a pivoting crash barrier for arresting an impacting vehicle without causing excessive injury to the driver. In particular, the present invention is directed to a crash barrier having an easily replaceable expendable gate which houses multiple plastically extensible cables mounted within for absorbing the energy of the impacting vehicle.

2. Description of the Related Art

Several types of crash barriers have been patented and manufactured historically. These gates rely upon supporting plastically deformable cables between anchorages on both sides of the roadway in order to establish a readily removable and insertable barrier, which can absorb impact energy through yielding of the cables. The existing products typically sustain damage to components other than their expendable gates, such as their anchorages, during major impacts.

Furthermore, some of the existing gates, such as the gate shown in U.S. Pat. No. 4,844,653 issued to Dickinson may inadvertently permit a vehicle to escape under the cable when a low-slung vehicle imparts upward motion to the gate during an impact. The gate shown in U.S. Pat. No. 4,989,835 issued to Hirsch may inadvertently unlatch if a vehicle applies uplift during an impact.

Another problem, inherent in the design of the crash gates that are currently available, is that the gates are difficult to produce and difficult to refurbish after undergoing impact. For example, the crash gate described in U.S. Pat. Nos. 6,115,963 and 6,289,634 B1 issued to Allardyce et al. has a very complex design for interlinking the cables in an effort to cause the multiple cables of the gate to work together more or less as a unit. This complex design makes the Allardyce gate difficult to assemble. Additionally, damage to the structure other than the gate is likely, making the unit difficult to refurbish after impact.

The present invention addresses the above-mentioned deficiencies of the other designs. In particular, the present invention provides a simpler gate construction, along with means for easing service of the units and means for minimizing the likelihood of damaging structural components of the gate, other than the gate itself. Further, the present invention provides improved latching to avoid inadvertent gate uplift and unlatching in a vehicular impact.

SUMMARY OF THE INVENTION

The present invention is a pivoting crash barrier for arresting an impacting vehicle without causing excessive injury to the driver. The crash barrier has an easily replaceable expendable gate which houses multiple plastically extensible cables mounted within for absorbing the energy of the impacting vehicle. The crash barrier gate is pivotally supported to rotate in a vertical plane on a horizontal shaft by an operator unit positioned on a first side of a roadway and an engagement stanchion engageable by the outer tip of the lowered gate on the second, opposed side of the roadway.

The crash barrier has an improved latch on the second side of the roadway that prevents inadvertent gate unlatching due to a vehicle imparting uplift to the gate.

The crash barrier has a simplified construction that serves to cause the cables to deform as a unit, rather than separately. Additionally, the heads of the upper sections of the crash barrier stanchions on both sides can pivot about the vertical axes of their respective mounting posts after the shearing of restraining shear pins whenever a vehicle impact occurs. This swiveling reduces the tendency for the components of the crash barrier, other than the gate, to sustain significant damage during vehicle impacts. A further feature of the present invention is a readily adjustable arrangement of the counterweights to bring the rotating components of the crash barrier into substantial balance.

One aspect of the present invention is a crash barrier comprising: (a) a gate, wherein the gate comprises: (i) at least one gate section having: (aa) a first and a second end, (bb) at least two vertical structures having a number of vertically spaced apart apertures, wherein the number and spacing of the apertures are substantially equal on the two vertical structures and wherein one vertical structure is positioned at the first end of the gate section and the other vertical structure is positioned at the second end of the gate section, (cc) a number of cable tubes, wherein the number of tubes is equal to the number of apertures in the vertical structures, the cable tubes extending substantially horizontally between and attached to the vertical structures such that an interior of each cable tube is aligned with one aperture in each of the vertical structures, and (dd) a plurality of tube ties spaced apart along the length of the cable tubes, wherein each tube tie is attached to at least two sides of each cable tube, (ii) an operator end piece mounted at an operator end of the gate, (iii) an engagement end piece mounted at an engagement end of the gate, and (iv) a plurality of substantially parallel spaced apart cables extending substantially horizontally from the operator end piece to the engagement end piece, wherein each cable is surrounded by one cable tube as the cable extends across each gate section and wherein each cable is anchored to the operator end piece and the engagement end piece; (b) an operator stanchion on one side of a roadway for raising and lowering the gate, the operator stanchion mounting the operator end piece; and (c) an engagement stanchion positioned on an opposed side of the roadway from the operator stanchion for selectably fastening the engagement end piece whenever the gate is in a closed position.

Another aspect of the present invention is a crash barrier is a crash barrier comprising: (a) a gate having an operator gate end and an engagement gate end; (b) an engagement stanchion positioned on one side of a roadway for selectably fastening the engagement gate end whenever the gate is closed, wherein the engagement stanchion comprises an engagement head rotatably mounted on an engagement mounting post and restrained from rotation about the engagement mounting post by at least one shear pin; and (c) an operator stanchion positioned on an opposed side of the roadway from the engagement stanchion for raising and lowering the gate, the operator stanchion attached to the operator gate end, wherein the operator stanchion comprises an operator head rotatably mounted on an operator mounting post and restrained from rotation about the operator mounting post by at least one shear pin.

Yet another aspect of the present invention is a crash barrier comprising: (a) a gate having a vertical midplane, an operator gate end, and an engagement gate end; (b) an engagement stanchion positioned on one side of a roadway for selectably fastening the engagement gate end whenever the gate is closed; (c) an operator stanchion positioned on an opposed side of the roadway from the engagement stanchion for raising and lowering the gate, the operator stanchion attached to the operator gate end, wherein the operator stanchion has a first wind stay support arm mounted on a first side of the operator stanchion on a first side of the vertical midplane of the gate and a second wind stay support arm mounted on a second side of the operator stanchion on a second side of the vertical midplane of the gate; and (d) a first and a second wind stay cable for laterally bracing the gate, each wind stay cable having an operator cable end and a gate end, wherein the operator cable end of the first wind stay cable is attached to the first wind stay support arm and the gate end of the first wind stay cable is attached to a first wind cable mount secured to the gate on the second side of the vertical midplane of the gate, and wherein the operator cable end of the second wind stay cable is attached to the second wind stay support arm and the gate end of the second wind stay cable is attached to a second wind cable mount secured to the gate on the first side of the vertical midplane of the gate.

Still yet another aspect of the present invention is a crash barrier comprising: (a) a gate having a vertical midplane, an operator gate end, and an engagement gate end; (b) an engagement stanchion positioned on one side of a roadway for selectably fastening the engagement gate end whenever the gate is closed; and (c) an operator stanchion positioned on an opposed side of the roadway from the engagement stanchion for raising and lowering the gate, the operator stanchion having a rotatable support arm assembly attached to the operator gate end at one end and supporting an adjustable counterweight assembly at a second end, the adjustable counterweight assembly comprising: (i) at least one counterweight anchor point affixed to the support arm assembly, the counterweight anchor point having a throughhole parallel to the support arm assembly adjacent the counterweight anchor point; (ii) a counterweight mounting plate having at least one threaded rod attached to a front side of the counterweight mounting plate, wherein one threaded rod passes through each throughhole whenever the counterweight mounting plate is mounted on the support arm assembly; and (iii) two threaded nuts threaded onto each threaded rod, one nut positioned on each side of the counterweigh anchor point where the threaded rod passes through the throughhole; whereby adjustment of the axial position of the nuts moves the counterweight mounting plate relative to the counterweight anchor points in a parallel direction to the support arm assembly adjacent the counterweight anchor point.

Yet another aspect of the present invention is a crash barrier comprising: (a) a gate having an operator gate end and an engagement gate end, the engagement gate end including a gate latchable member with a horizontal detent; (b) an operator stanchion positioned on one side of a roadway for raising and lowering the gate; and (c) an engagement stanchion positioned on an opposed side of the roadway from the operator stanchion for selectably fastening the engagement gate end whenever the gate is closed, the engagement stanchion comprising a head having a gate anchorage assembly mounted thereon wherein the gate anchorage assembly includes: (i) a pair of anchorage plates spaced apart sufficiently to admit entry of the engagement gate end between the anchorage plates, (ii) a guidance means for guiding the engagement gate end into the anchorage assembly, and (iii) a pivotable latch plate comprising: (aa) a horizontal latching surface, (bb) a pivot point, (cc) a spring-biased means for urging the latching surface outwardly to engage the horizontal detent of the gate latchable member, and (dd) a latch release means for pivotably disengaging the latching surface from the horizontal detent of the gate latchable member, wherein the latch release means is selectably activated by a pull solenoid.

A further aspect of the present invention is a crash barrier comprising: (a) a gate, wherein the gate comprises: (i) at least two gate sections, each gate section having: (aa) a first and a second end, (bb) at least two vertical structures having a number of spaced apart apertures, the number and spacing of the apertures being substantially equal on the vertical structures and where one vertical structure is positioned at the first end of the gate section and the other vertical structure is positioned at the second end of the gate section, (cc) a number of cable tubes, wherein the number of tubes is equal to the number of apertures in the vertical structures, the cable tubes extending substantially horizontally between and attached to the vertical structures such that an interior of each cable tube is aligned with one aperture in each of the vertical structures, and (dd) a plurality of tube ties spaced apart along a length of the cable tubes, each tube tie attached to at least two sides of each cable tube, (ii) an operator end piece mounted at an operator gate end, (iii) an engagement end piece mounted at an engagement gate end, (iv) means for connecting the gate sections together such that the cable tube interiors and the apertures of the vertical structures are aligned along a length of the gate, and (v) a plurality of substantially parallel spaced apart extensible cables extending substantially horizontally from the operator end piece to the engagement end piece, wherein each cable is surrounded by one cable tube as the cable extends across each gate section and is anchored at a first cable end by the operator end piece and at a second cable end by the engagement end piece; (b) an operator stanchion on one side of a roadway for raising and lowering the gate, the operator stanchion comprising: (i) an operator head, (ii) an operator mounting post, wherein the operator head is rotatably mounted on the operator mounting post and restrained against rotation about the operator mounting post by at least one shear pin, (iii) an operator anchorage assembly symmetrically mounted on the operator head about a vertical centerline plane of the gate, (iv) a support arm assembly having a shaft journaled in the operator head, wherein the support arm assembly is rotatable about a pair of coaxial journals supporting the shaft, (v) an adjustable counterweight assembly supported by the support arm assembly, and (vi) means for attaching the operator end of the gate to the support arm assembly; and (d) an engagement stanchion positioned on an opposed side of the roadway from the operator stanchion for selectably fastening the gate in a closed position, the engagement stanchion comprising (i) an engagement head rotatably mounted on an engagement mounting post and restrained against rotation about the engagement mounting post by at least one shear pin, (ii) an engagement anchorage assembly symmetrically mounted on the engagement head about a vertical centerline plane traverse to the roadway, wherein the engagement anchorage assembly includes a pair of anchorage plates, spaced apart sufficiently to admit the entry of an outside end of the engagement end piece, and an anti-uplift latch.

BRIEF DESCRIPTION OF THE DRAWINGS

For a more complete understanding of the present invention, and the advantages thereof, reference is now made to the following descriptions taken in conjunction with the accompanying drawings, in which:

FIG. 2 is an oblique view of the operator stanchion side of the crash barrier upon which the gate assembly is supported on the first side of the crash barrier showing the gate assembly in its fully open position;

FIG. 3 is an oblique view of the engagement stanchion assembly that performs the latching of the crash barrier gate assembly on the opposed side of the roadway from the operator stanchion assembly;

FIG. 9 is a vertical profile view of the engagement stanchion looking along the axis of the gate assembly as seen from the roadway;

FIG. 36 is an oblique partial view of the gate assembly showing the attachment of the crossed wind stay cables to the gate.

DESCRIPTION OF THE PREFERRED EMBODIMENTS

Figure 1:
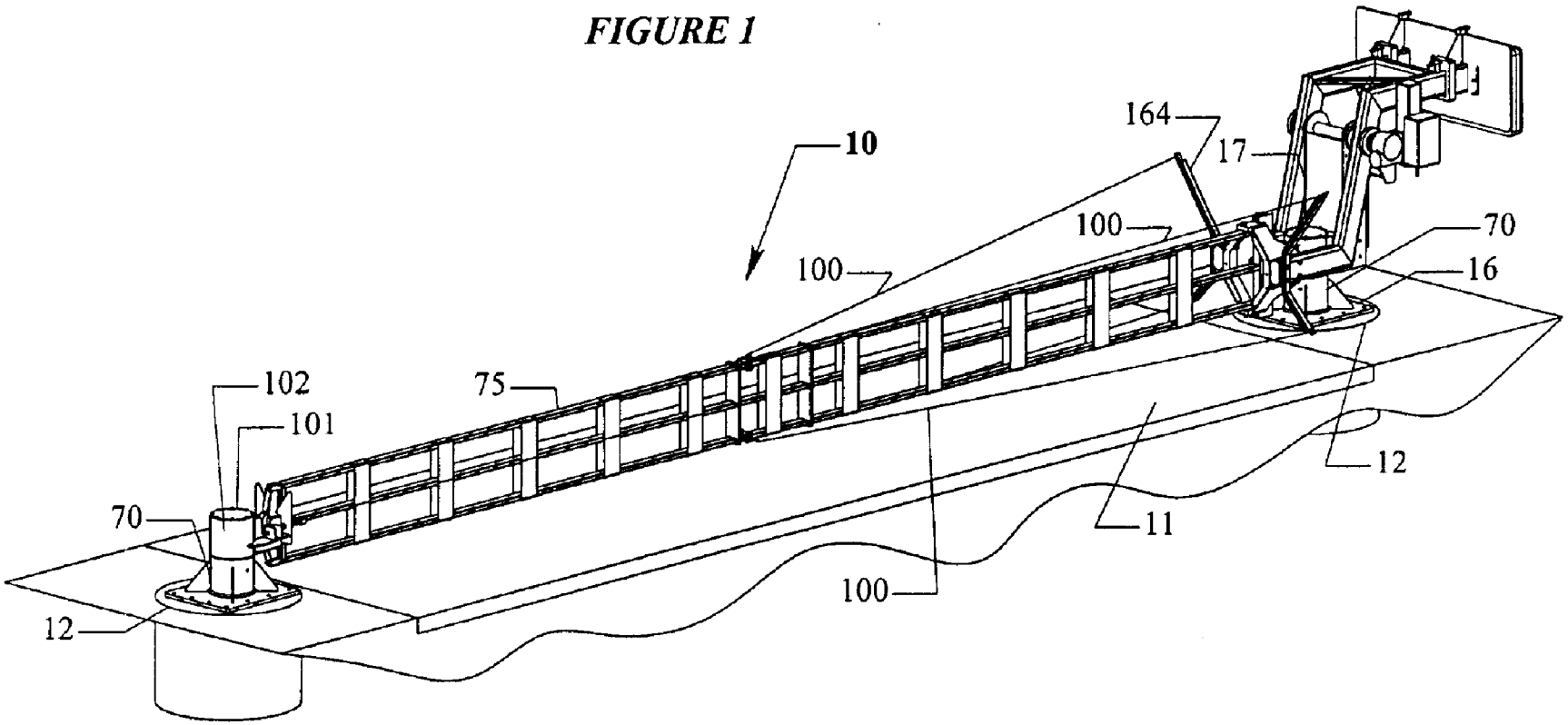
FIG. 1 is an oblique view of the crash barrier of the present invention positioned on a roadway showing the gate assembly in its lowered and latched position blocking the roadway.
Figure 4:
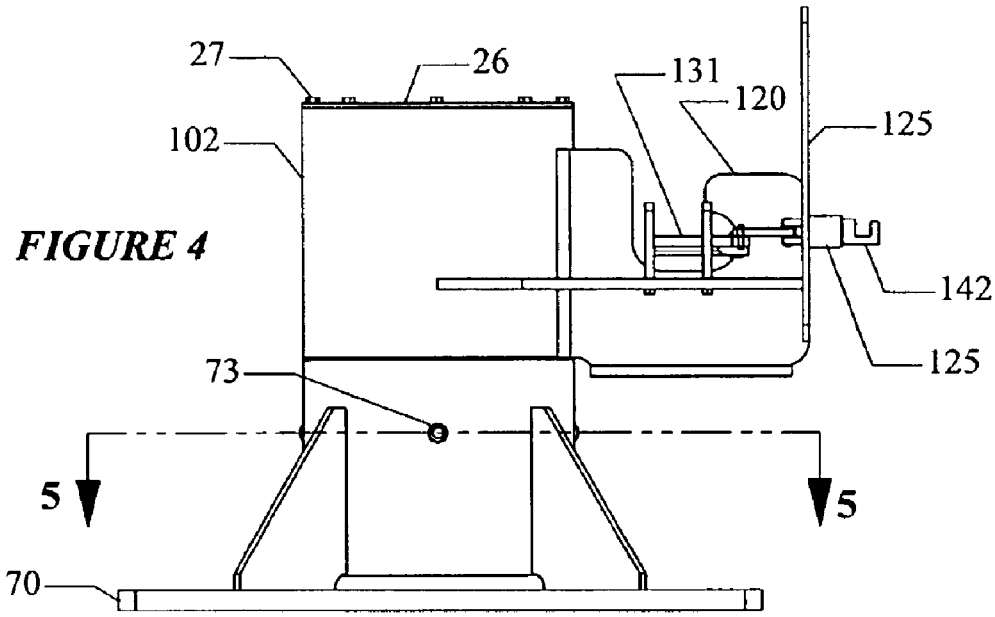
FIG. 4 is a profile view of the engagement stanchion assembly transverse to the axis of the gate assembly.

The present invention is directed to a pivoting crash barrier for arresting an impacting vehicle without causing excessive injury to the driver. In particular, the present invention is directed to a crash barrier having an easily replaceable expendable gate that houses multiple plastically extensible metal cables for absorbing the energy of the impacting vehicle.

The crash barrier gate is pivotally supported to rotate in a vertical plane on a horizontal shaft by an operator unit positioned on a first side of a roadway and an engagement stanchion engageable by the outer tip of the lowered gate on the second, opposed side of the roadway. The crash barrier has an improved latch on the second side of the roadway that prevents inadvertent gate unlatching due to a vehicle imparting uplift to the gate.

The crash barrier also has a simplified construction that serves to cause the cables to deform as a unit, rather than separately. Additionally, the heads of the upper sections of the crash barrier stanchions on both sides will, upon impact, pivot about the vertical axes of their respective mounting posts after shearing the restraining shear pins. This swiveling reduces the tendency for the components of the crash barrier, other than the gate, to sustain significant damage during vehicle impacts.

Referring now to the drawings, it is pointed out that like reference characters designate like or similar parts throughout the drawings. The Figures, or drawings, are not intended to be to scale. For example, purely for the sake of greater clarity in the drawings, component sizes and spacing are not dimensioned as they actually exist in the assembled embodiment.

Referring to FIGS. 1 and 2, the basic construction of the crash barrier 10 can be seen. The crash barrier is positioned with its operator stanchion 16 on a first side of a roadway 11 and with its engagement stanchion 101 on the opposed side of the roadway.

Figure 10:
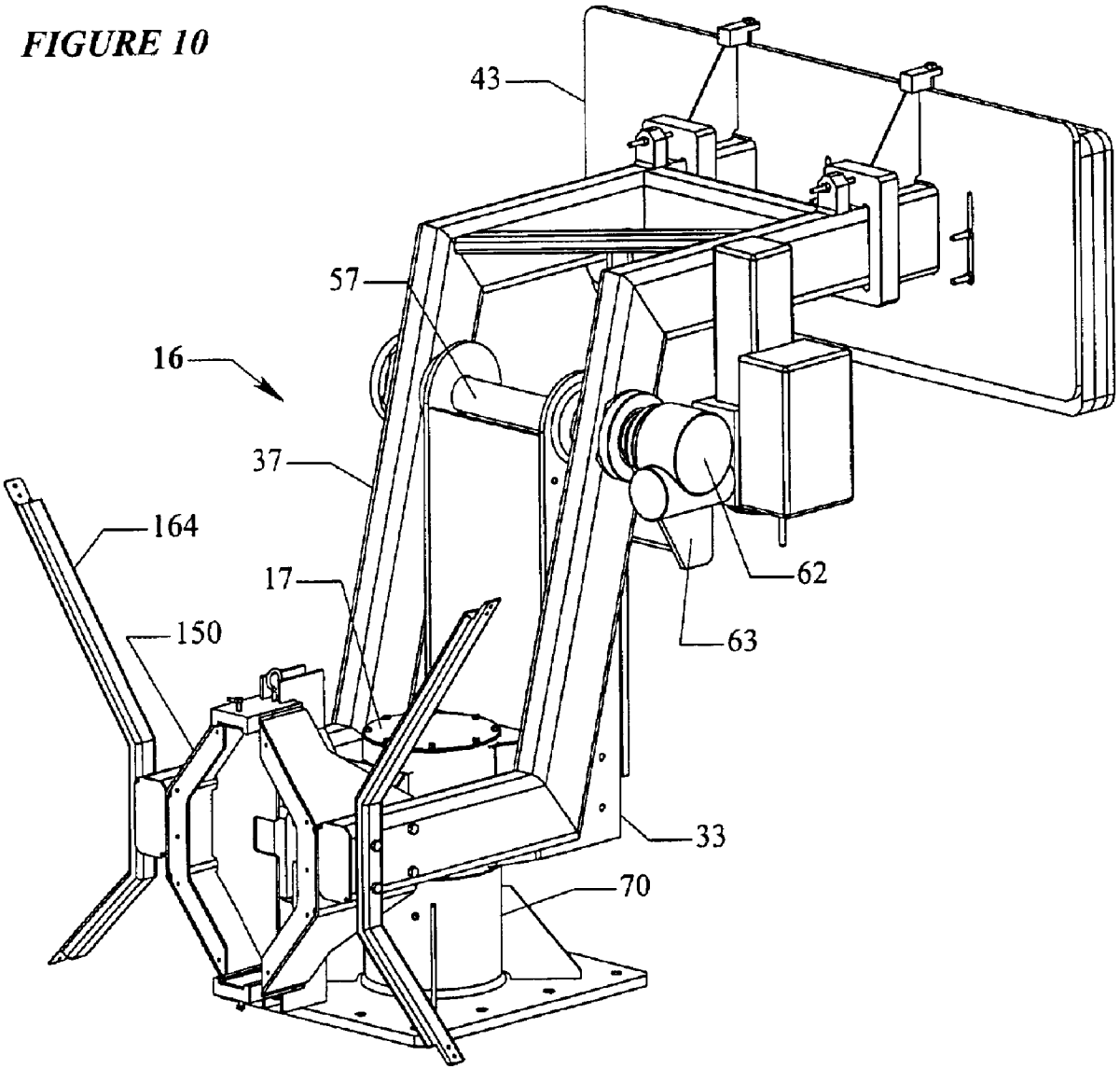
FIG. 10 is an oblique view of the operator stanchion assembly with the mechanism in the down position.

Operator stanchion 16 comprises an actuator head 17, a mounting post 70, a support arm assembly 37, a counterweight assembly 43, an arm box 150 and a shaft 57. Operator stanchion 16, which supports and operates the gate assembly 75 to cause the crash barrier 10 to be selectably opened and closed, is mounted to foundation 12 adjacent to roadway 11. Foundation 12 may be the deck of a bridge or alternatively the ground, in which case a footing for mounting will be provided in the ground, as shown in FIG. 1. The mounting bolts for the base plate of posts 70 are not shown. Actuator head 17 is mounted on mounting post 70, as shown in FIGS. 2 and 10.

The construction of the elements of crash barrier 10 may be made of a variety of suitable materials. Preferably the main structural components are made of steel, with the exception of the gate assembly tubes, which are rectangular aluminum extruded tubing, and the actuator, which is probably housed in a gray iron casting. The shear pins 72 and 163 are preferably made of brass or soft steel, while the counterweight assembly is preferably made of cast iron material, lead, or steel plate. The arm shaft bearings 35 are preferably either a filled or unfilled plastic such as PTFE or a filled low friction plastic blend. The O-rings 30 typically will be nitrile (Buna N) rubber.

The engagement stanchion 101, shown in FIGS. 3 to 9, is located on the opposed side of the roadway 11 from the operator stanchion 16. The engagement stanchion 101 serves to anchor the outer end of the gate assembly 75 when the gate is closed, as is shown in FIG. 1, and to release the gate assembly to allow the crash barrier gate to be opened, as shown in FIG. 2.

The engagement stanchion 101 is mounted to the foundation 12 in the same manner used for the operator stanchion 16. The engagement stanchion head 102 of the engagement stanchion 101 is mounted into its mounting post 70, where it is restrained against axial movement and held by shear pins against rotation until a vehicle impact. Engagement stanchion head 102 has support cylinder 103, shown in FIG. 7, as a supporting base structure for the other components of the engagement stanchion head.

Support cylinder 103 consists of a short, heavy walled cylindrical tubular head body 19 with a bolt hole circle array of drilled and tapped holes on its upper transverse face for mounting of the lid 26 by means of lid screws 27 and with stab-in extension 20 welded into its bottom counterbored end. The weld is made on the upper end of stab-in extension 20 inside the bore of tubular head body 19. Stab-in extension 20 is a close slip fit into the counterbore of tubular head body 19. Stab-in extension 20 is a short cylindrical element with constant inner and outer diameters.

The exposed lower cylindrical end of stab-in extension 20 has, from its upper end, a male O-ring groove 22, an upper annular bearing strip mounting groove 24*a*, and a lower annular bearing strip mounting groove 24*b*, all with transverse shoulders. An array of equispaced radially drilled and tapped holes 23 for the retention bolts 21 is positioned in a horizontal transverse plane in the stab-in extension 24 between the upper and lower bearing mounting grooves 24*a* and 24*b*. Below the retention bolt holes 23, in a transverse horizontal plane, is an array of multiple, equispaced shear pin holes 25, shown in FIGS. 5 and 7.

O-ring 30 is positioned in groove 22 to prevent water and other corrosive fluids from seeping into the mounting post 70. Upper bearing 31 is preferably formed from a strip of plastic, such as a glass-filled polytetrafluoroethylene (PTFE), which is bent into a loop and inserted into bearing groove 24*a*. The thickness of bearing 31 is such that it radially extends beyond the cylindrical surface of stab-in extension 20. The lower bearing 32, mounted in the lower bearing groove 24*b*, is similarly formed. The lower bearing 32 also radially extends beyond the surface of extension 20.

Circular disk lid 26 has a thin transverse flange on its upper side. Circular disk lid 26 is attached to the top of tubular body head 19 of support cylinder 103 by means of screws 27, which are mounted into a bolt hole circle in the flange of the lid 26 that are comated with the drilled and tapped holes in the top of tubular head body 19. The lid 26 is removable to selectably extend or retract the heads of the retention bolts 21. Lid 26 is a close fit into the bore of tubular head body 19 and provides stiffening against deformations of the tube of body 19.

Mounted on tubular head body 19 on the roadway side of engagement stanchion head 102 and symmetrical about the vertical centerline plane transverse to the roadway 11 is the engagement stanchion gate anchorage assembly 119, which may be seen in detail in FIGS. 3 through 8. The gate anchorage assembly 119 consists of anchorage plates 120 and horizontal reinforcing brackets 122 and 123, along with guidance means to assist engaging the gate assembly when it is laterally deflected by wind.

The gate anchorage assembly 119 has two identical anchorage plates 120 symmetrically offset from the vertical centerline plane of the gate assembly 75 transverse to the roadway 11 of the crash barrier and welded onto the cylindrical face of tubular head body 19, as shown in FIGS. 3 through 9. The gap between the two anchorage plates 120 is sufficient to admit with appropriate clearance the main body of the arm end piece 82 mounted on the outer end of the gate arm assembly 75.

Both anchorage plates 120 of the engagement stanchion side of the crash barrier 10 have corresponding identical transverse pin engagement detents 121 cut into their upper sides and extending into the central portion of the anchorage plates. The geometry of the pin engagement detents 121 of the gate anchorage plates 120 is determined by the trajectory of the crossbars 83 of the outer arm end piece 82 during rotation of gate arm assembly 75, installation tolerances, and service temperature induced length changes of the components of the crash barrier 10. The shape of the detents 121 is such that the crossbars 83 of the arm end piece 82 can enter from above and be restrained against removal out of the detent.

Pin engagement detents 121 are designed to resist the disengagement of the arm end piece 82 during vehicle impact. For example, the detents 121 have an approximate "L" shape with rounded corners having radii corresponding to those of the crossbars 83 of the arm end piece 82. The horizontal extent of the detents 121 is of necessity greater than the crossbar pin diameter because of fabrication tolerances and the need for operational clearances resulting from the pivoting of the gate assembly 75 in the vertical plane about shaft 57 of operator stanchion 16. In addition, the detents 121 ensure retention of the arm end piece 82 with a projection of the anchorage plate 120 into the detent 121 that is located above the crossbar 83 whenever the arm end piece 82 is shifted toward the roadway 11 during a vehicle impact. Thus, when a vehicle impact occurs, the crossbars 83 of the gate become trapped in the lower horizontal arm of the "L". The crash barrier 10 is also designed to ensure that upward forces resulting from a vehicle impact do not disengage the crossbars 83 from the detents 121. The resistance to upward movement of the gate assembly 75 and the crossbars 83 is provided by an anti-uplift latch assembly 131 mounted on the operator stanchion 16. This mechanism is discussed later in the specification.

The anchorage plates 120 are joined together at the bottom by horizontal "U"-shaped bottom horizontal brace 122, which is welded onto the anchorage plates 120. The anchorage plates 120 are each further reinforced by a horizontally positioned side horizontal brace plate 123, which are welded both to the exterior of tubular head body 19 and theirs respective anchorage plates 120.

Transverse to the vertical midplane of the gate assembly 75 and welded symmetrically to the transverse roadway end of the horizontal brace plates 123 are two vertical mirror-image arm guide plates 124. The location of arm guide plates 124 can be seen in FIG. 9 for the vertical positioning of plates 124 relative to the desired engaged centerline axis of crossbar 83 of the outer arm end piece 82 of the gate assembly 75 and in FIG. 30 for the horizontal positioning of the plates. The bottom end of outer arm end piece 82 will be engaged by the upwardly facing transverse faces inclined from vertical if end piece 82 is laterally displaced by wind during gate closure. The size of the upward end of the gap between the plates is selected to be sufficiently larger than twice the maximum expected in service deflection of the intact gate arm plus the transverse thickness of arm end piece 82. The minimum gap between the arm guide plates 124 is selected so that the outer arm end piece 82 is able to freely pass with minimal excess clearance and be engaged by the pin engagement detents 121 of the engagement stanchion gate anchorage 119. A through clearance hole is provided in the arm guide plates 124 offset to the outside of the gap for guidance of arm end piece 82. A short latch release guide bushing 125 is concentrically welded with the clearance hole on the roadway side of lefthand guide plate 124, as viewed in FIG. 9. The bore of guide bushing 125 provides a slip fit for the release bar 142 of the anti-uplift latch 131.

Figure 30:
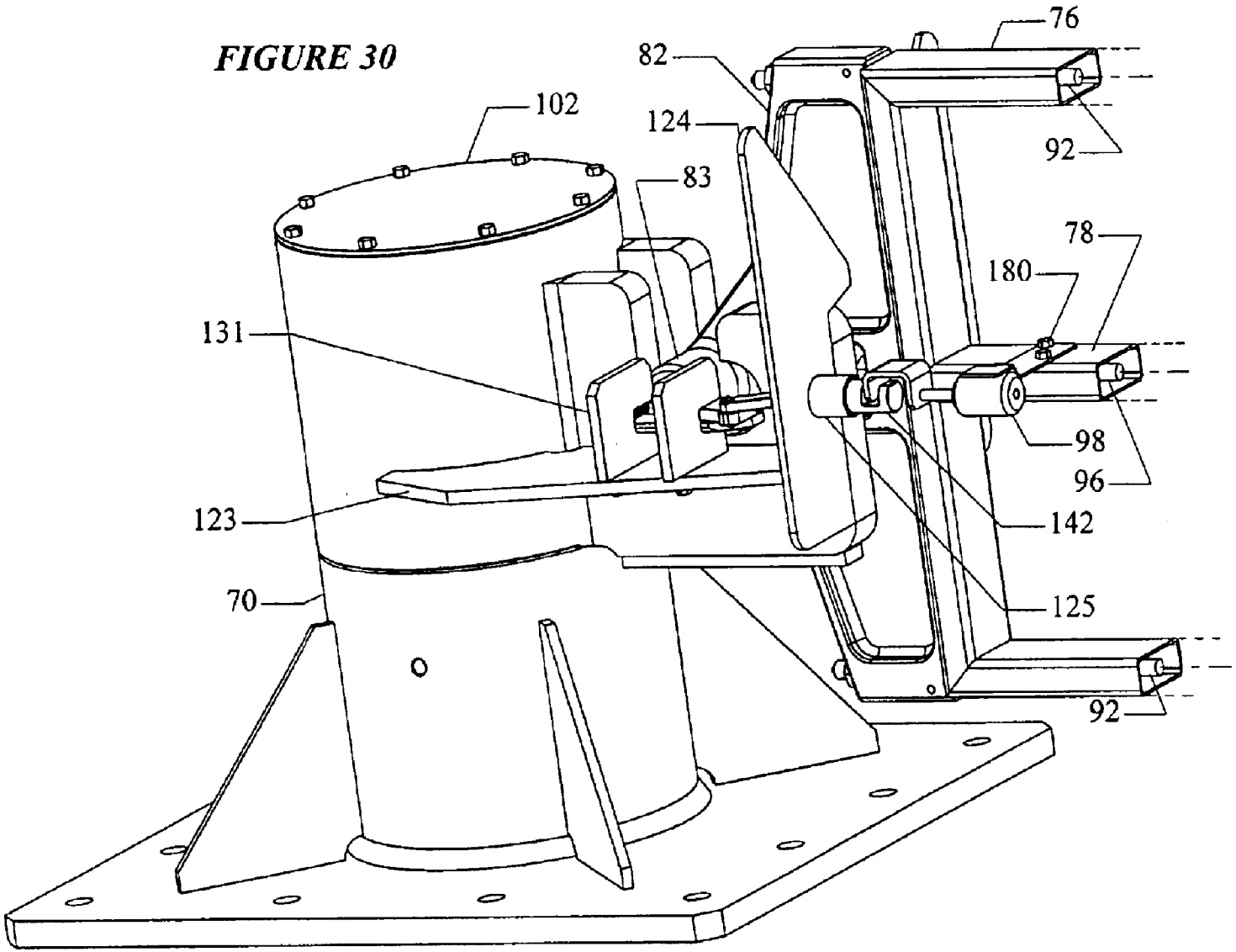
FIG. 30 is another oblique view of the engagement stanchion assembly with the latched end of the closed crash barrier gate.

Mounting post 70 into which engagement stanchion 101 is stabbed primarily consists of a vertical heavy-walled section of structural steel pipe or tubing which is welded on its bottom end to a strong horizontal base plate, as can be seen in FIGS. 3 and 30. The mounting post 70 into which the operator stanchion 16 is mounted is the same as used to mount the engagement stanchion. The connection between the vertical axis tube and the base plate is further strengthened and stiffened by welded vertical gusset plates interconnecting the tube and the base plate of mounting post 70. The rectangular base plate of mounting post 70 is provided with bolt holes in a pattern which can be used to mount either to a structural support in a bridge or to a prepared reinforced concrete footing foundation 12, as shown in FIG. 1. The foundations are sized to support the reactions applied to them through a vehicle impact on the crash barrier 10. The base plate of post 70 is mounted with bolts for a bridge or anchor bolts for a prepared footing foundation [bolts not shown].

Figure 8:
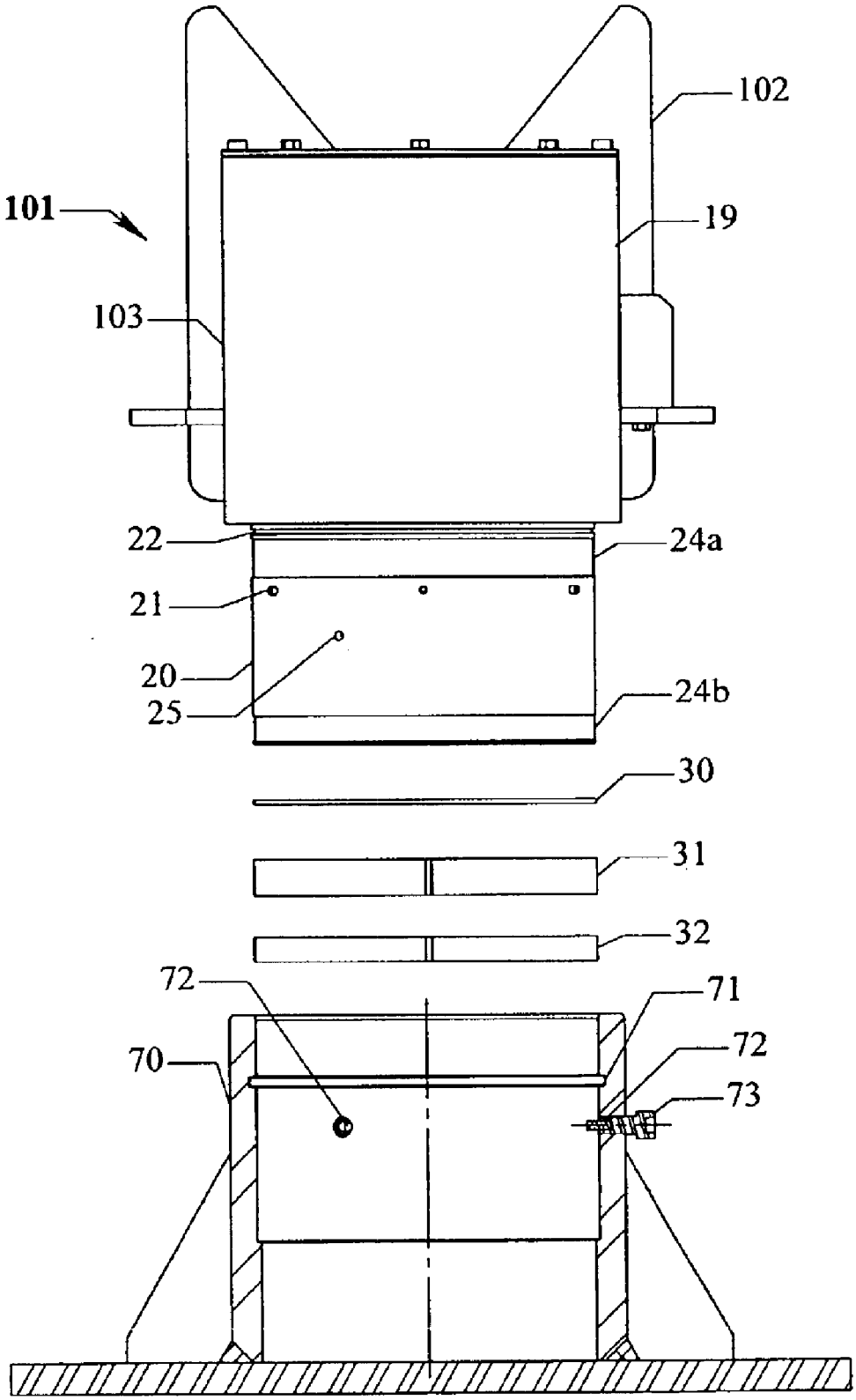
FIG. 8 is an exploded partial vertical sectional view of the engagement stanchion along the same section line as for FIG. 7, but showing details of the mounting of the engagement stanchion upper head in more detail.

Referring to FIG. 8, the upper end of the tubular portion of post 70 is counterbored to accept the stab-in extension 20 of either support cylinder 18 of actuator head 17 or the support cylinder 103 of engagement stanchion head 102 and has a lead-in taper for permitting successful insertion of O-ring 30 so that the O-ring can seal between stab-in extension 20 and the bore of the tube of mounting post 70. Intermediate in the counterbore of post 70 is retention groove 71 into which the ends of retention bolts 21 can be radially inserted in order to attach engagement stanchion head 102 to post 70 in a manner to resist both bending and axial forces while still permitting rotation about the vertical tubular axis of post 70. The axial position of the retention groove 71 is selected to correspond to that of the retention bolts 21 in stab-in extension 20 when the bottom transverse end of either support cylinder 18 or support cylinder 103 abuts the top transverse surface of the tube of mounting post 70.

Figure 5:
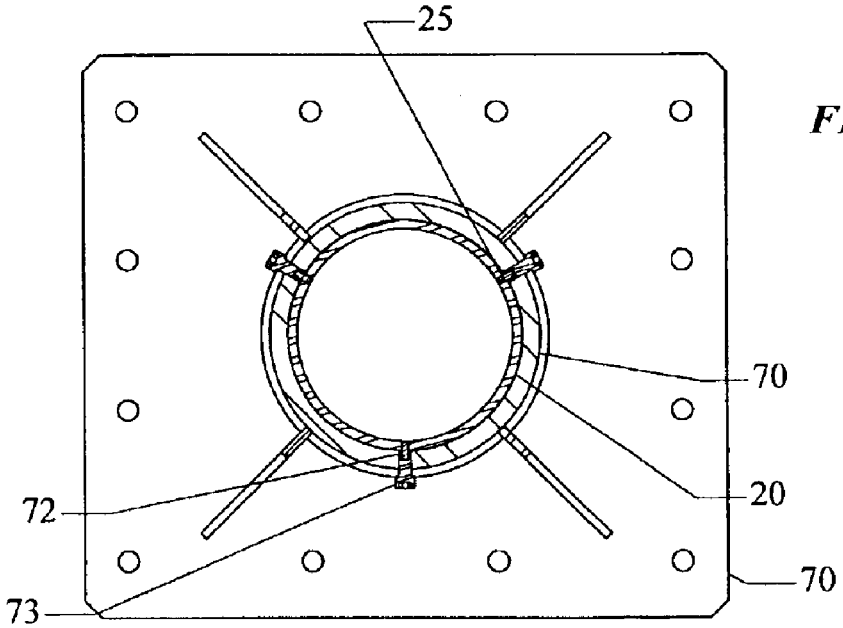
FIG. 5 is a horizontal cross-section taken along line 5—5 of FIG. 4 of the engagement stanchion through the shear pins that restrain the upper head of the engagement stanchion from rotation prior to a vehicle impact on the gate assembly.
Figure 6:
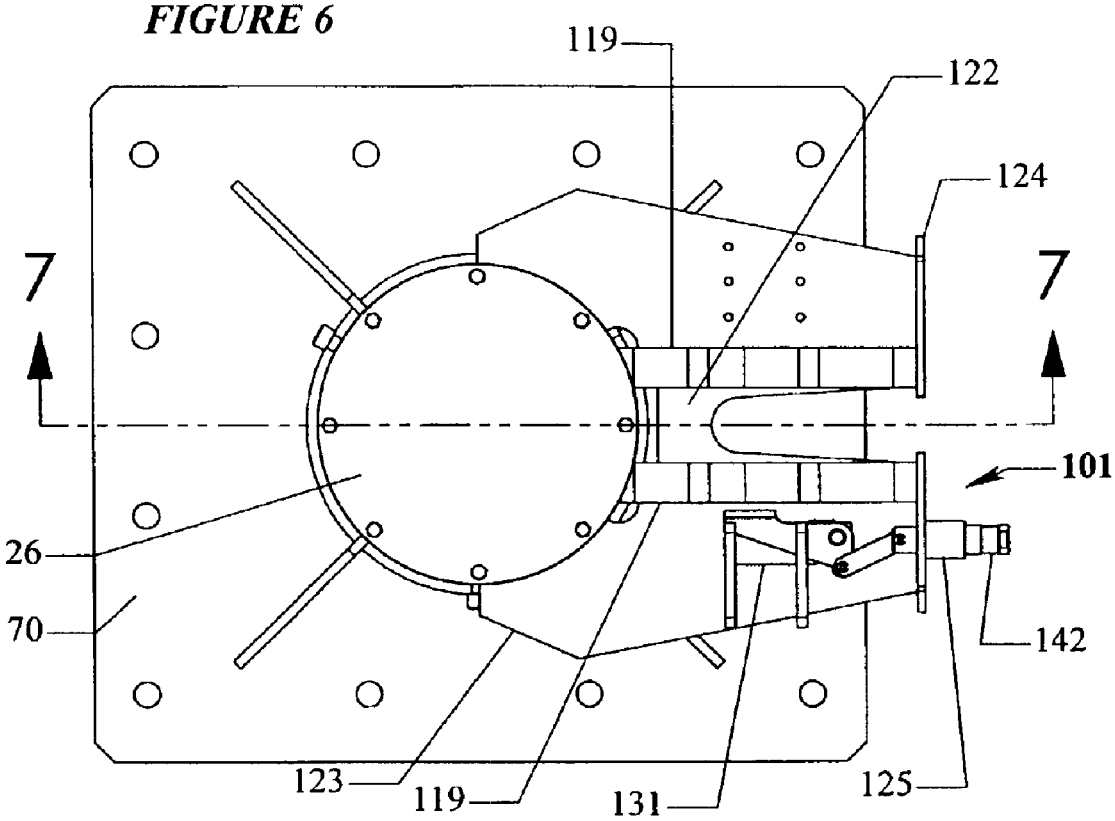
FIG. 6 shows a plan view of the engagement stanchion.
Figure 7:
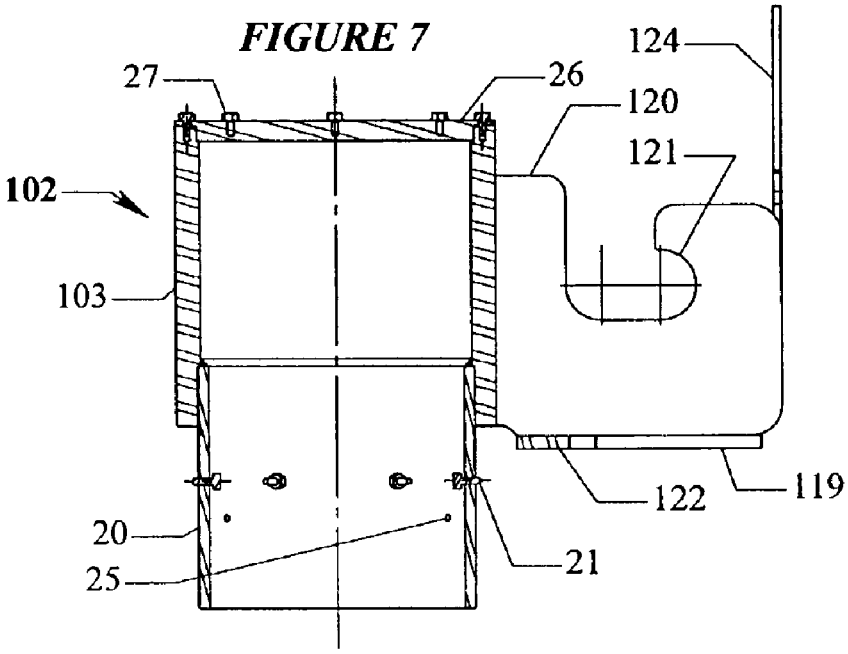
FIG. 7 is a vertical cross section of an upper portion of the engagement stanchion in the plane of the gate assembly and along line 7—7 of FIG. 6, showing the internals of the engagement stanchion.

The tubular portion of post 70 has multiple drilled and tapped radial shear pin screw mounting holes in a transverse horizontal plane which are coaxial with and comatable with the shear pin holes in the bottom portion of stab-in extension 20. Multiple shear pins 72 have reduced diameter tips that are a close fit to the corresponding shear pin holes 25 in stab-in extension 20. The outer ends of shear pins 72 are mounted in blind holes drilled in the threaded end of shear pin mounting screws 73. As shown in FIG. 5, the shear pins 72 may be engaged in the holes 25 in stab-in extension 20 by screwing shear pin mounting screws 73 into the threaded holes in mounting post 70 in order to prevent rotation of either the engagement stanchion head 102 or the actuator head 17 about the vertical axis of post 70 as long as the shear pins are intact. The material of the shear pins is selected to provide a reliable, predetermined shear value so that the rotational break-away torque for the connection will exceed any normal loads from wind, earthquake, and the like, but the connection will reliably shear to permit either or both the head 17 or the head 102 to freely rotate when exposed to the relatively much larger loadings attendant with a vehicle impact on the gate arm assembly 75.

Figure 21:
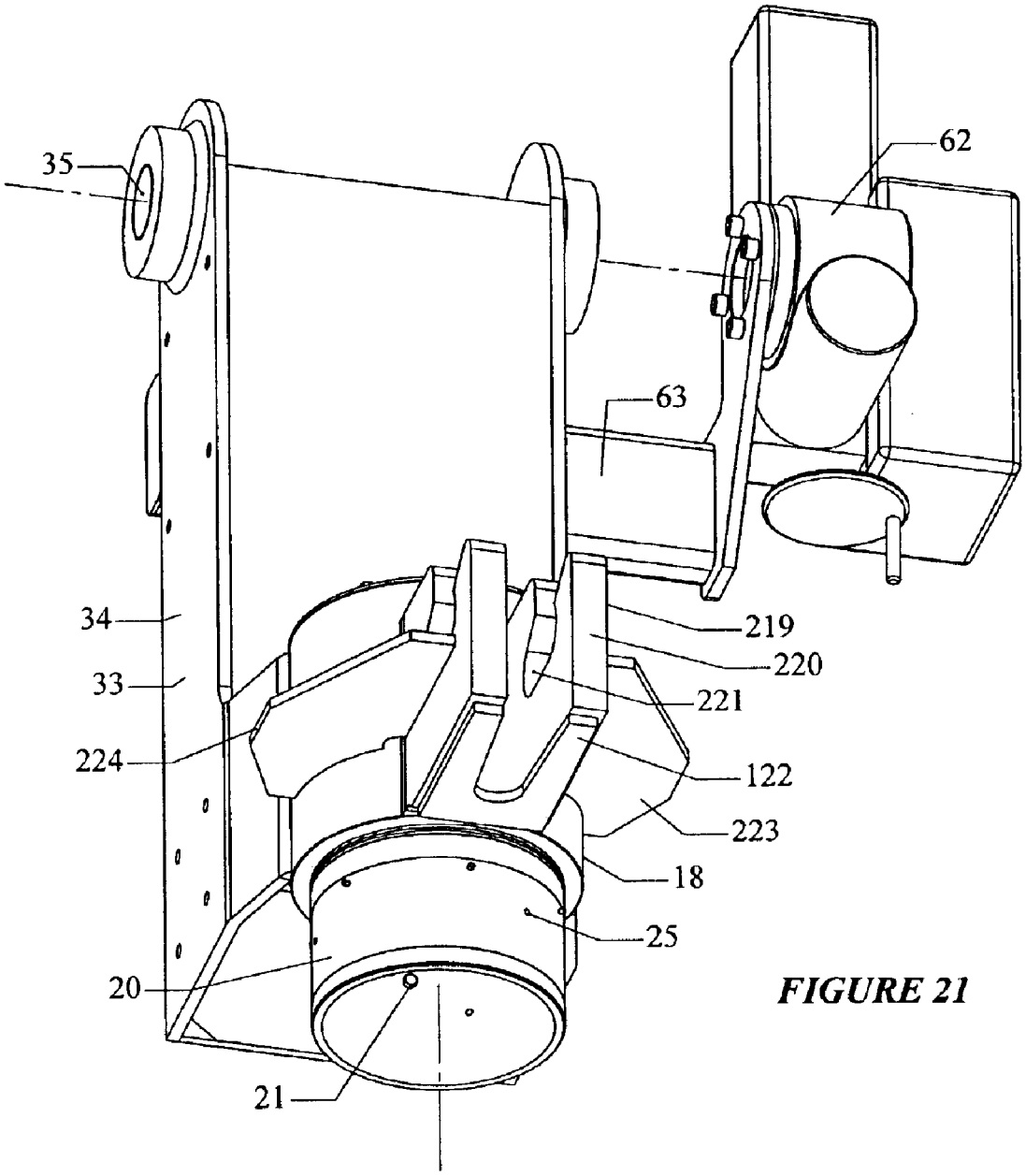
FIG. 21 is an oblique view from both the gate assembly side and below of the upper actuator head and arm support assembly of the operator stanchion assembly.
Figure 22:
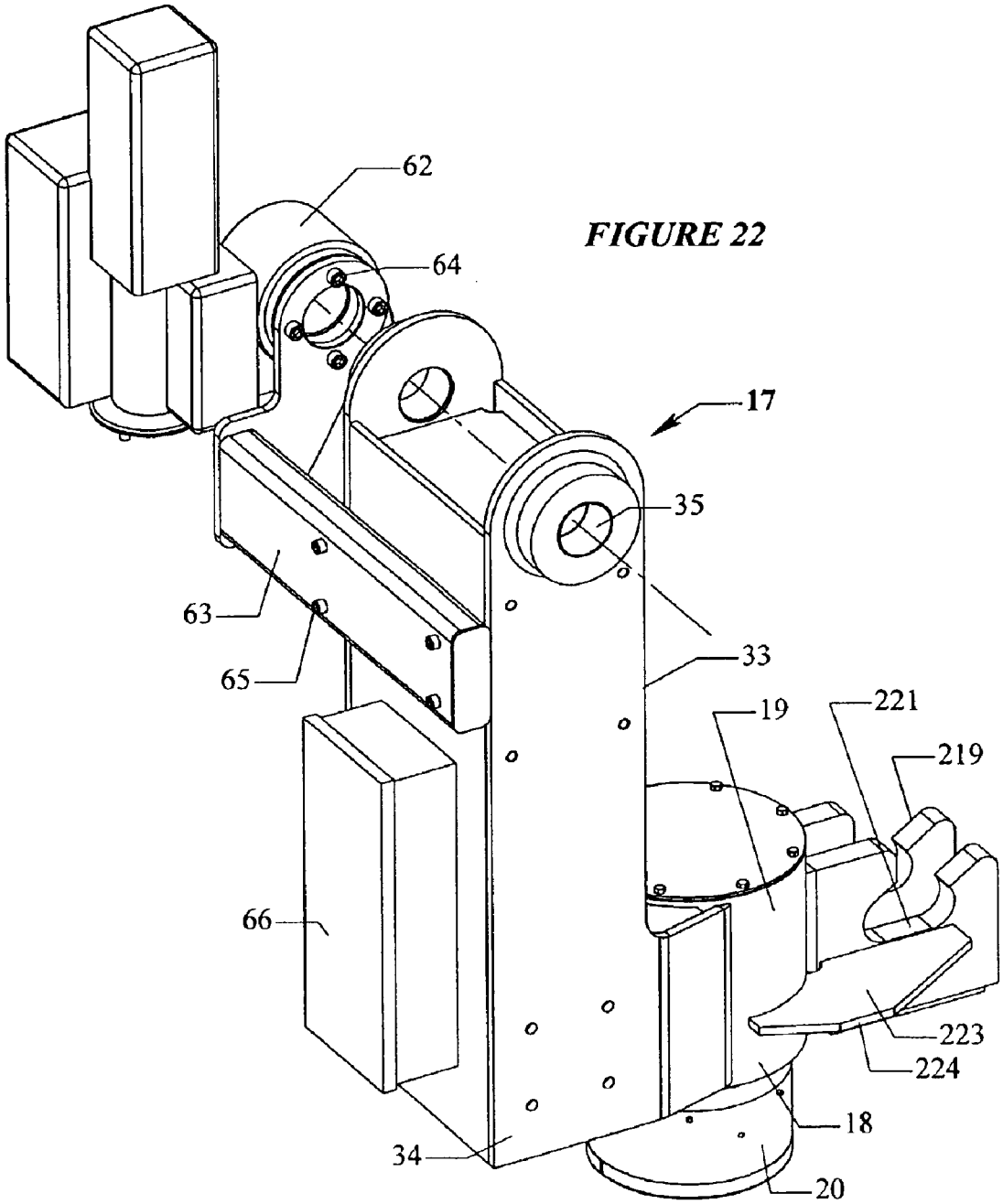
FIG. 22 is an oblique view from the rear side and above of the upper actuator head and arm support assembly of the operator stanchion assembly.
Figure 23:
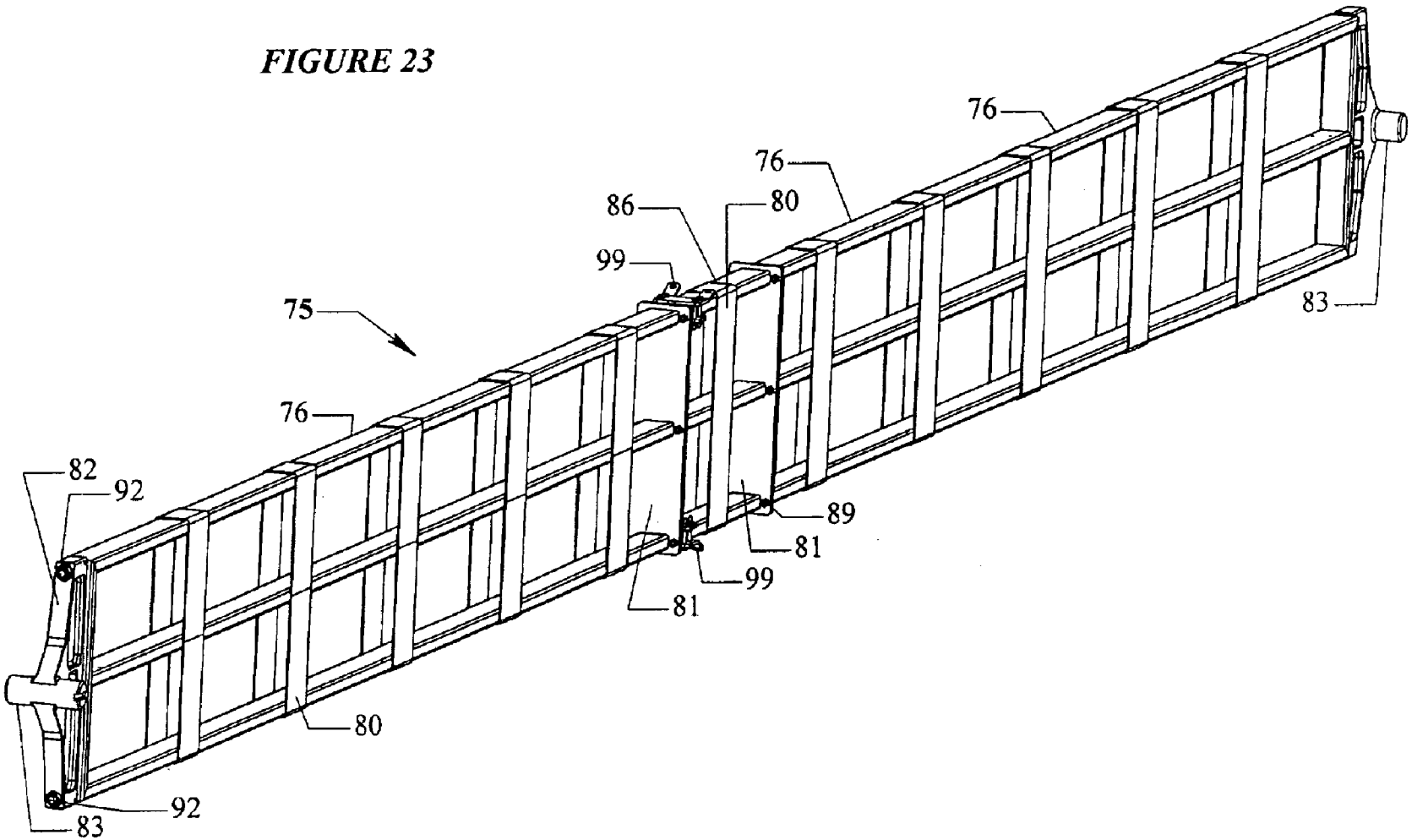
FIG. 23 is an oblique view of a gate assembly of the present invention.
Figure 24:
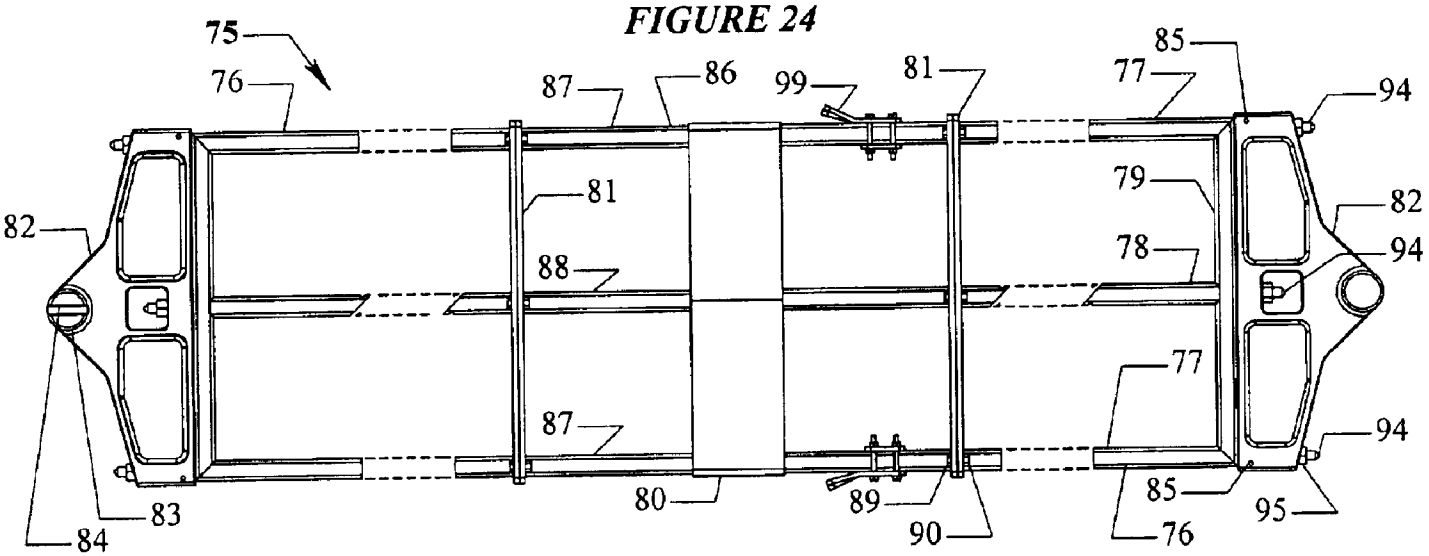
FIG. 24 is a partial profile view of the gate assembly normal to the gate axis.
Figure 25:
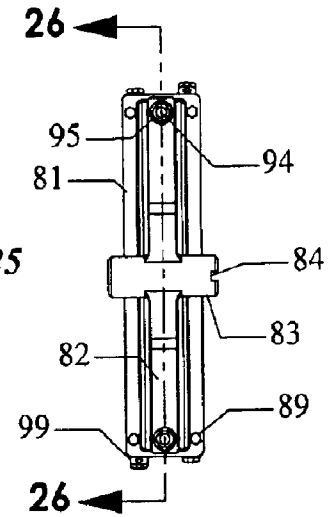
FIG. 25 is an end view of the gate assembly viewed along the axis of the gate.

Actuator head 17, shown in detail in FIGS. 10, 21, and 22, has support cylinder 18 as a supporting base structure for the other components of the actuator head. The tubular head body 19, of the support cylinder 18 of the actuator head 17 of the operator stanchion 16, is identical to that of the tubular head body 19 of the support cylinder 103 of the engagement stanchion 101. As is the case for the engagement stanchion head 102, the actuator head 17 is configured to be supported by a mounting post 70. The second mounting post 70, together with the actuator head 17, constitute the operator stanchion 16 for the crash barrier 10. The mounting post for the operator stanchion is positioned at the opposed side of the roadway 11 directly across from where the engagement stanchion 101 is located, as can be seen in FIG. 1.

Mounted on tubular head body 19 on the roadway side of actuator head 17 and symmetrical about the vertical centerline plane transverse to the roadway 11 is the actuator stanchion gate anchorage 219, which may be seen in detail in FIGS. 21 and 22. Gate anchorage 219 consists of anchorage plates 220 and reinforcing braces 122 and 223 similar to those for gate anchorage 119 of the engagement stanchion 101. The same basic system of gate engagement and restraint is used for both the operator stanchion and the engagement stanchion 101. However, modifications from the geometry of the pin engagement detents 121 of the engagement stanchion side gate anchorage plates 120 are needed for the actuator side gate anchorage plates 220 in order to accommodate the differences in geometry caused by the different trajectory of the crossbars 83 of the inner arm end piece 82 during rotation of gate arm assembly 75.

The actuator stanchion gate anchorage 219 has two identical plates 220 symmetrically offset from the vertical centerline plane of the gate assembly 75 transverse to the roadway 11 of the crash barrier and welded onto the cylindrical face of tubular head body 19, as shown in FIGS. 21 and 22. The gap between the two anchorage plates 220 is sufficient to admit with appropriate clearance the main body of the arm end piece 82 mounted on the inner end of the gate arm assembly 75. Both anchorage plates 220 have corresponding identical transverse pin engagement detents 221 cut into their upper sides and extending into the central portion of the anchorage plates. The shape of the detents 221 is such that the crossbars 83 of the arm end piece 82 can enter from above and be restrained against horizontal motion out of the detent.

Pin engagement detents 221 have an approximate "L" shape with rounded corners having radii corresponding to those of the crossbars 83 of the arm end piece 82. The horizontal extent of the detents 221 is of necessity somewhat more than the crossbar pin diameter because of fabrication tolerances and the need for operational clearances resulting from the pivoting of the gate assembly 75 in the vertical plane about shaft 57 of operator stanchion 16. Additionally, retention of the arm end piece 82 in the detents 221 is ensured by a projection of the anchorage plate 220 into the detent 221 that becomes positioned above the crossbar 83 when the arm end piece is shifted toward the roadway 11 during a vehicle impact. When a vehicle impact occurs, it is desired that ultimately the crossbars 83 of the gate become trapped in the roadway end of the lower horizontal arm of the "L".

It is necessary to ensure that a vehicle impact which results in upward forces and attendant upward movement of gate assembly 75 and its attached crossbars 83 is insufficient to disengage the crossbars from the pin engagement detents 221. As shown, no anti-uplift latch assembly 131 is mounted on the operator stanchion 16. However, such a latch may be added if the inertial resistance of the support arm assembly 37 with its attached arm box 150 and counterweight assembly 43, along with the gate assembly 75, is insufficient to prevent upward movement and loss of retention of crossbars 83.

The anchorage plates 220 are joined together at the bottom by a horizontal bottom brace 122, which is welded onto the anchorage plates 220. The anchorage plates 220 are each further reinforced by a horizontally positioned side brace plate 223, which is welded both to the exterior of tubular head body 19 and its respective anchorage plate 220, as shown in FIG. 21. The horizontal brace plate 223 is similar to the horizontal brace plate 123 of engagement stanchion 101, but is provided with a transverse arm support shoulder 224. Arm support shoulder 224 is a vertical edge of the horizontal brace plate 223 that is parallel to the vertical midplane of the gate assembly 75 and spaced to provide operational clearance with the arm reaction pads 170 of the support arm assembly 37 during normal operation. However, the transverse arm support shoulder 224 will abut the arm reaction pads 170 when the arm assembly 37 is elastically deflected against the support shoulder 224 under the force of a vehicle impact. This interaction of the support shoulder 224 and the reaction pads 170 at impact operates to reduce the bending loads in the arm assembly.

Support arm assembly 33 supports the shaft 57, which in turn supports the support arm assembly 37 and the attached arm box 150, counterweight assembly 43, and the mounted gate assembly 75. The support arm assembly, shown in FIGS. 10, 21 and 22, is a welded box structure fabricated from plates and welded to the cylindrical side of the support cylinder 18 of the actuator head 17 of the operator stanchion 16. The support arm assembly 33 is symmetrical about the vertical midplane of the gate assembly 75.

Mounted on support cylinder 18 and symmetrically offset from the vertical centerline plane transverse to the roadway 11 are the parallel mirror image vertical side plates 34 of support arm bracket 33. The side plates 34 have a vertical inward bend close to their inwardly extending connection tabs by which they are welded to the support cylinder 18. The side plates 34 project upwardly and to the rear away from the roadway 11 and are joined together for most of their height on both their forward and rear faces by identical rectangular vertical transverse plates, thereby forming a vertical axis box beam. The upper ends of the side plates 34 are rounded and have coaxial transverse shaft clearance holes which are reinforced on their outer sides by thick reinforcing rings having concentric bores. Shaft bearings 35 are pressed into the bores of the reinforcing rings on the side plates 34. The bearings 35 are shown as annular sleeve bearings made of a lubricative plastic such as PTFE, but bronze bearings or roller bearings are also suitable.

A horizontal cross plate is located slightly below the shaft bearings 35 and connected to both the side plates 34 and vertical transverse plates to further reinforce the box structure of support arm bracket 33. Spaced apart upper and lower horizontal tie plates interconnect both the vertical transverse plates and the side plates 34 with the cylindrical surface of the tubular head body 19, thereby forming a substantially tubular interconnection beam with a horizontal axis to join the previously mentioned vertical box beam to the tubular head body. The upper horizontal tie plate connects near the top of tubular head body 19, while the lower horizontal tie plate connects near the bottom. A second horizontal cross plate closes the bottom opening between the side plates 34 and the vertical transverse plates. The resulting support arm bracket is thus sufficiently strong and stiff to handle the eccentric loads applied by the offset shaft mounting used with this arrangement. If necessary, additional stiffening may be added internally to support arm bracket 33. The rear vertical transverse plate of support arm bracket 33 provides a mounting surface with a rectangular array of drilled and tapped holes for mounting the controls box 66.

Figure 11:
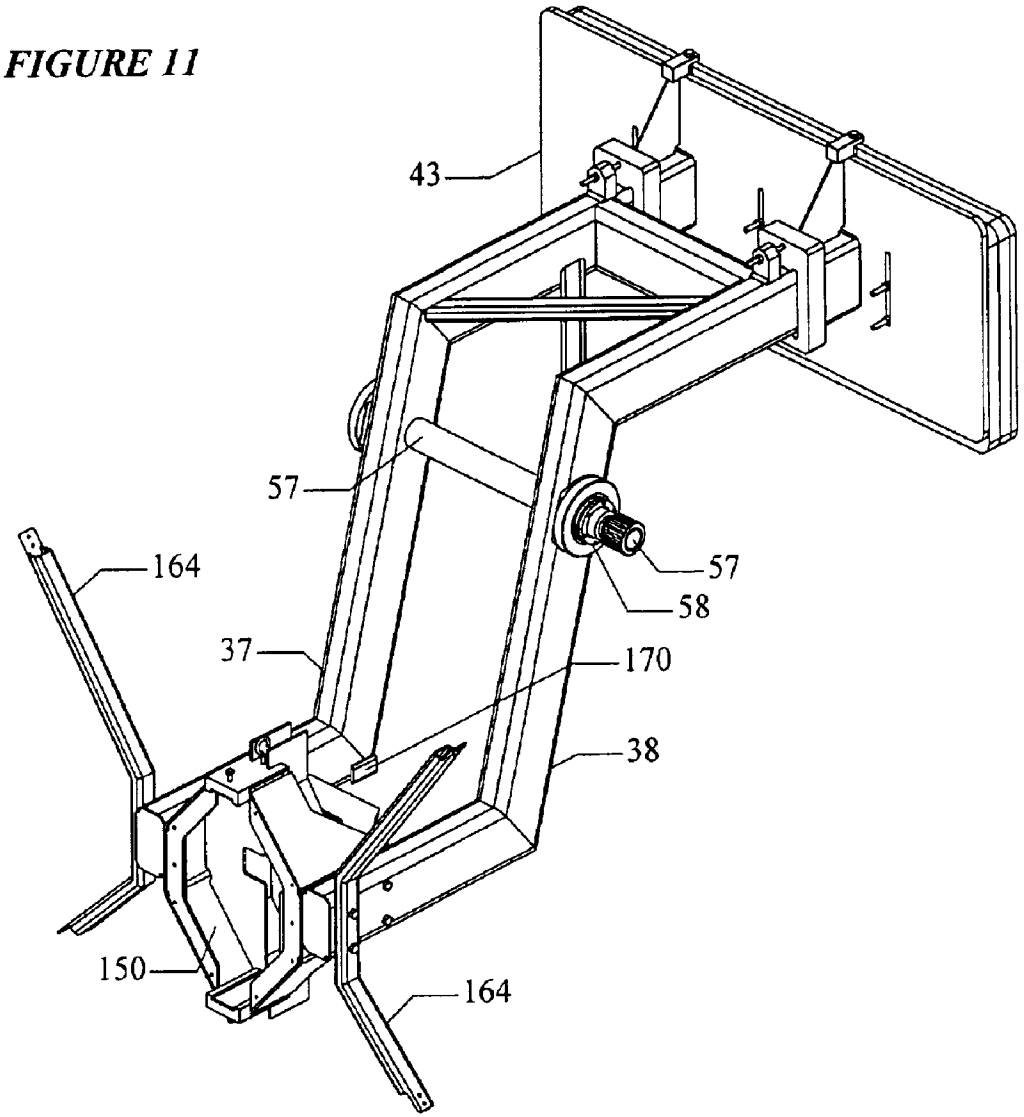
FIG. 11 is an oblique view of the combined arm, arm box, and counterweight assemblies of the operator stanchion assembly.

The arm structure 38 of support arm assembly 37 is a weldment which primarily consists of two identical laterally spaced parallel arm tubes made of rectangular steel tubing or some other suitable steel structural section, such as pipe or wide flange sections. Each arm has two parallel end pieces offset from each other and each joined by a butt weld to a center piece, as shown in FIGS. 10 and 11. The center piece is inclined relative to each arm by an angle of about 105°, so that the profile of the arm is an open "Z", rather than a "Z" with acute angles between tubes.

Each arm tube of arm structure 38 has a coaxial shaft clearance through hole in the center piece transverse to the vertical centerline plane of the gate assembly 75 and located at approximately one quarter of the length of the center piece from the rear arm end piece on the side away from the roadway 11. The outboard ends of the transverse holes have concentric heavy reinforcing rings or plates with concentric through holes having a diameter equal to or slightly less than those of the transverse holes in the arm tubes. The centers of these holes establish the axis of rotation of the support arm assembly 37. The rear end of the arm structure 38 has a perpendicular tubular cross member joining the end tubes of the arms and two smaller vertically offset X-brace tubes parallel to the plane of the two end tubes. The X-brace tubes are located between the cross member tube and the joints of the rear arm tubes with their center pieces.

Figure 12:
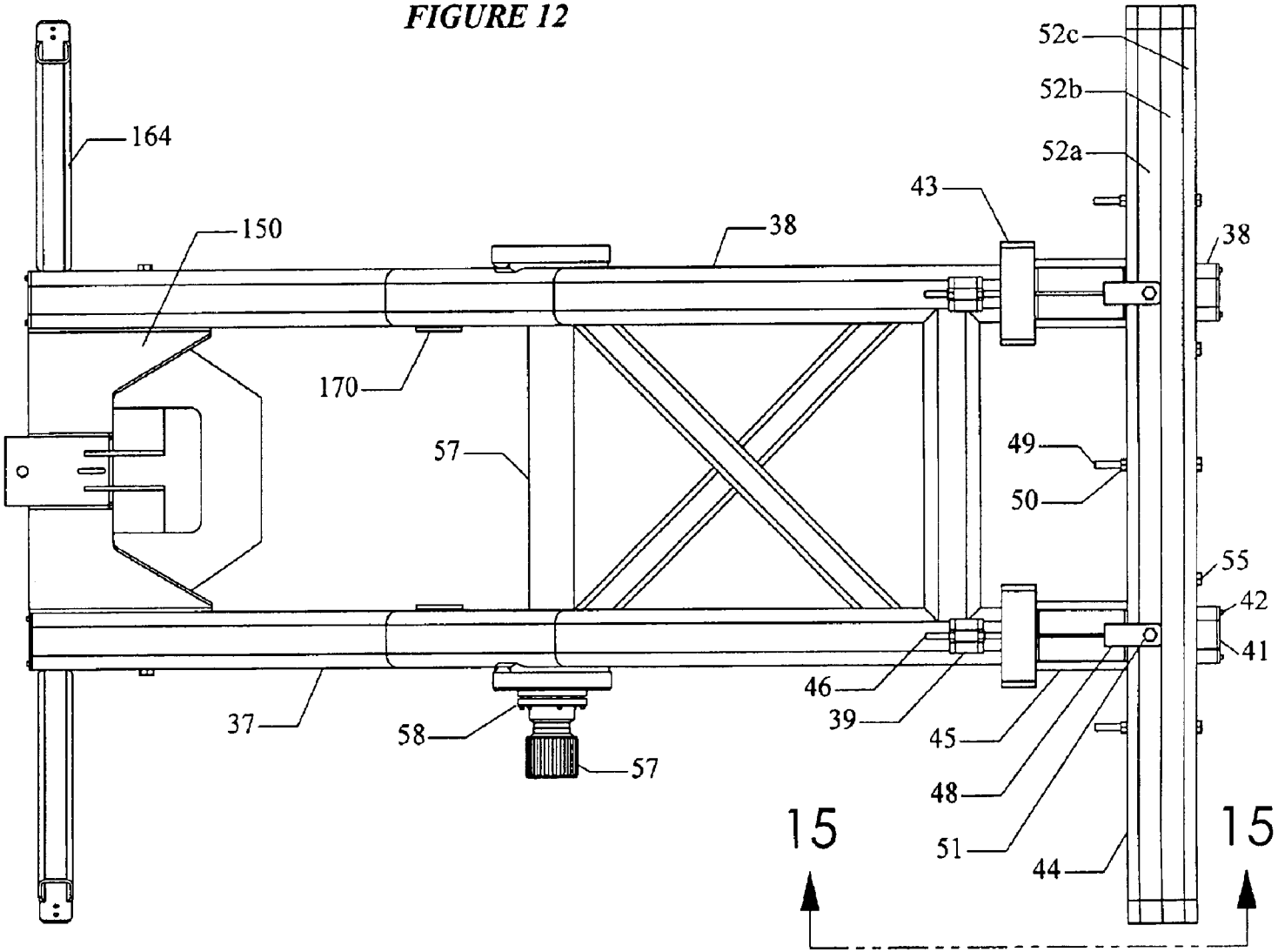
FIG. 12 is a plan view of the combined arm, arm box, and counterweight assemblies of the operator stanchion assembly.
Figure 13:
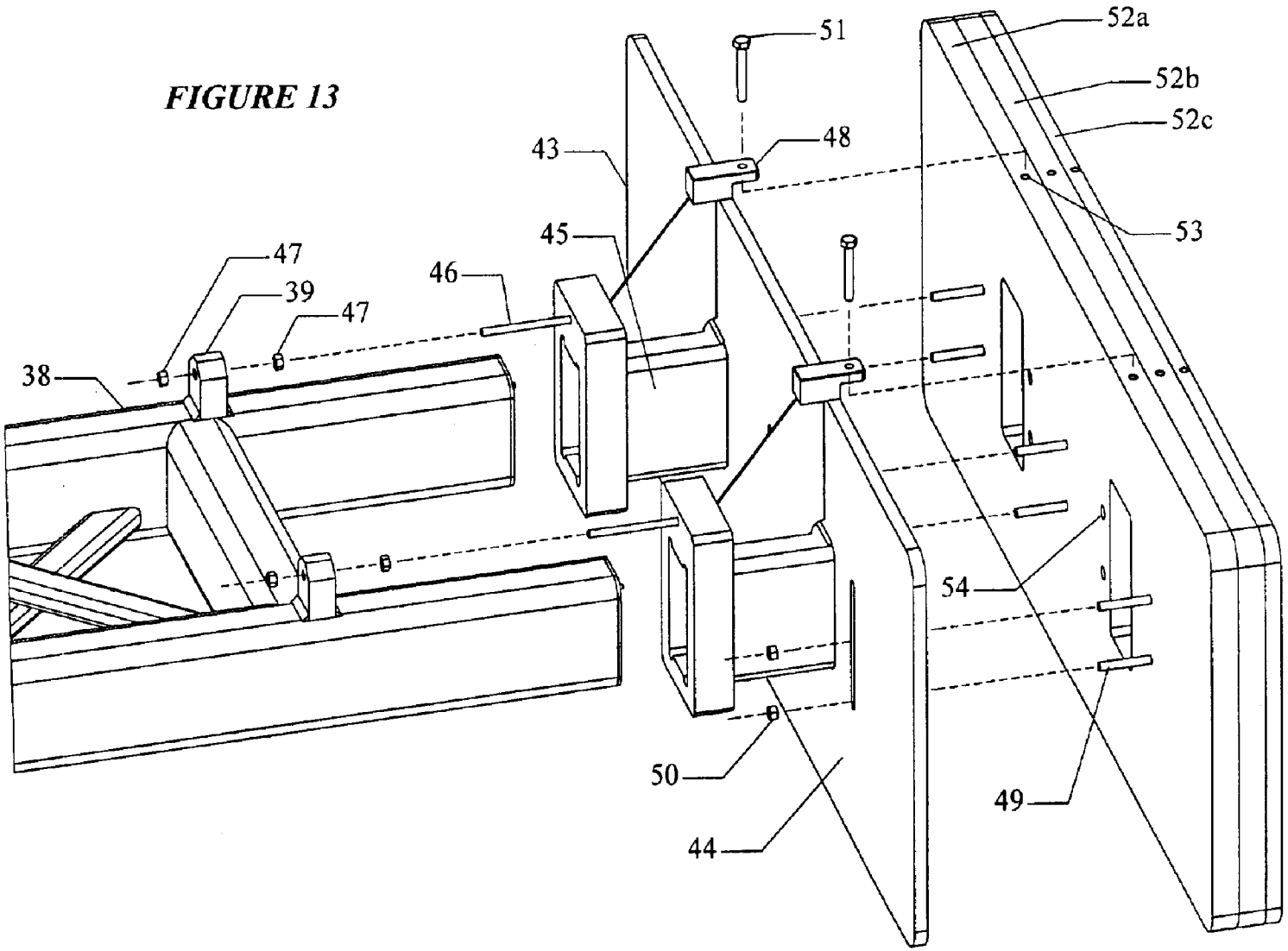
FIG. 13 is an exploded oblique detail view of the outer end of the arm assembly showing the longitudinally adjustable mounting of the counterweight assembly.
Figure 14:
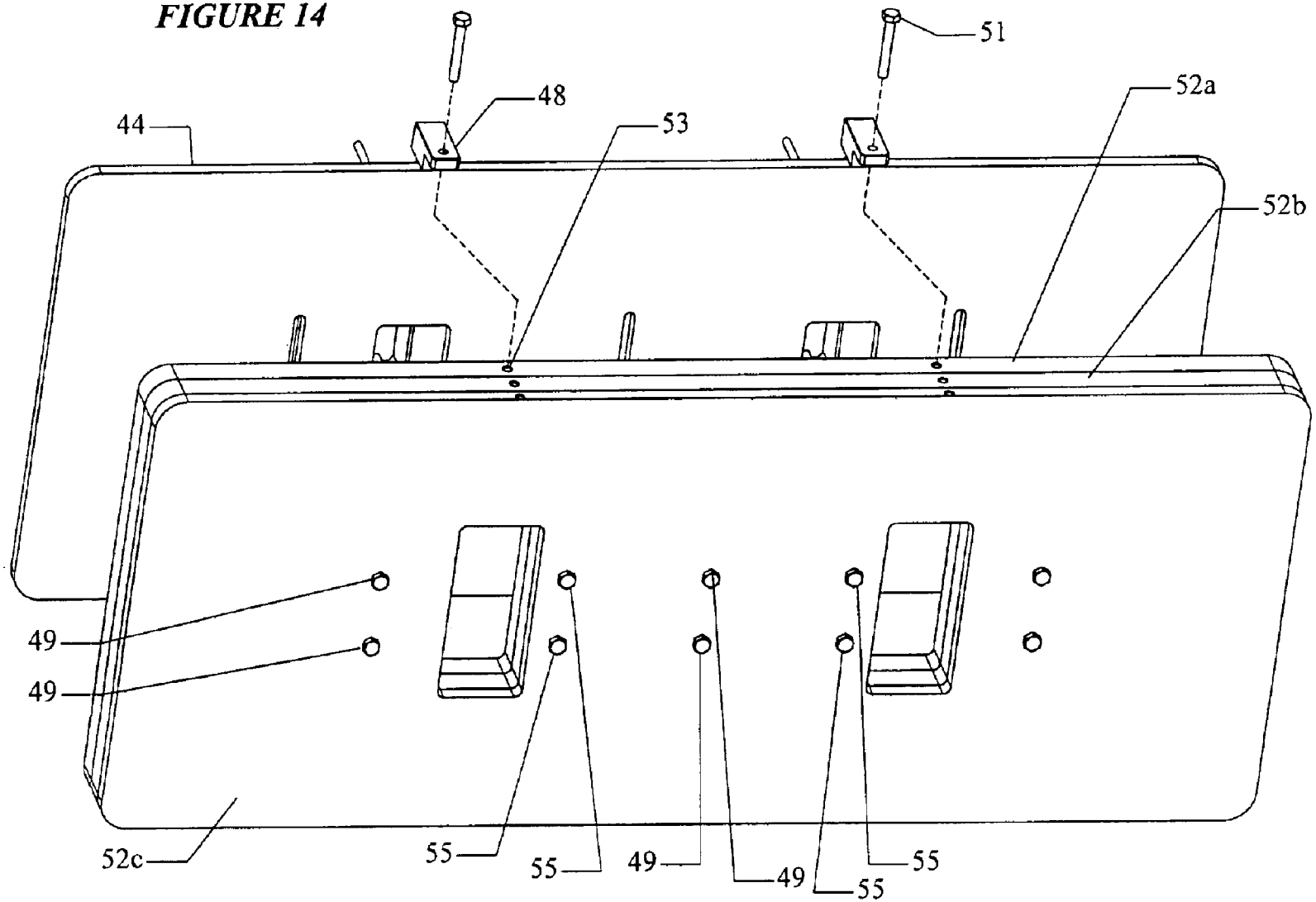
FIG. 14 is an exploded oblique detail view of the counterweight assembly showing the adjustable mounting arrangement for the transversely adjustable counterweight plates.
Figure 15:
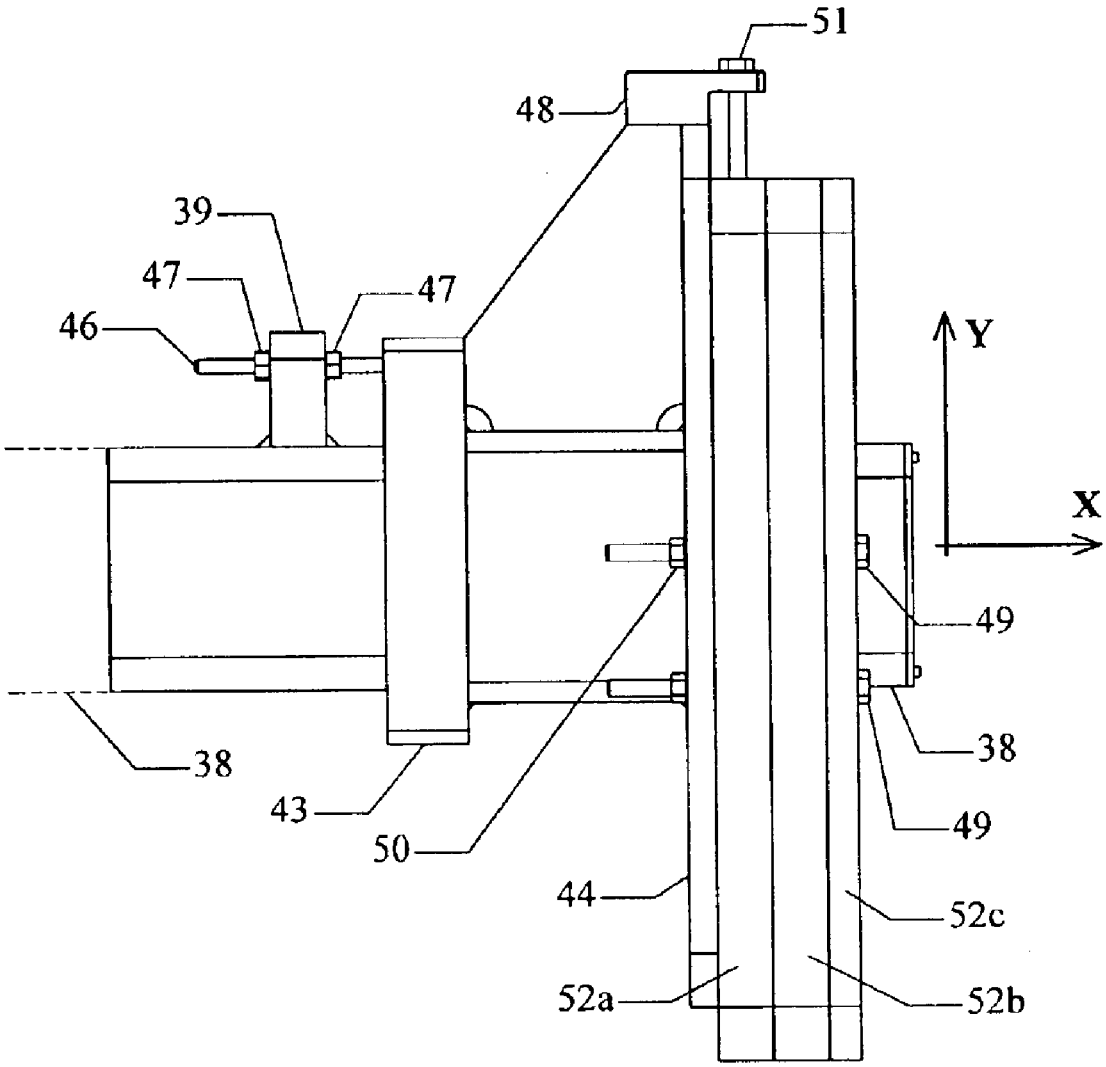
FIG. 15 shows a transverse detail side profile view of the outer end of the arm assembly, taken along line 15—15 of FIG. 12, showing how the counterweight assembly is mounted on the arm assembly.

As seen in FIGS. 10 to 12, two counterweight anchor points 39 are symmetrically positioned on the upper surface of the rear arm tubes adjacent the cross member. The counterweight anchor points 39 are steel blocks which are welded to the rear arm tubes with their widest faces normal to the axis of their rear arm tubes. Each counterweight mounting point has an approximately central drilled through hole that is parallel to the axis of its rear end tube. The ends of the forward arm end tubes nearest the gate assembly 75 have identical arrays of horizontal transverse through bolt holes that serve as arm box mounting holes. The ends of both the forward and rear end tubes have drilled and tapped holes for mounting plate end caps 41 by means of end cap screws 42. The end caps, as seen in FIG. 12, are provided with holes corresponding to the pattern of drilled and tapped holes in the arm end tubes to accommodate the end cap screws 42. On the inboard side of the arm tubes at the joints between the forward end tubes and the center pieces, plate arm reaction pads 170 are mounted. When the arm structure 38 is in its lowered position and the crash barrier 10 is closed, the arm reaction pads are positioned adjacent to, but slightly separated from, the arm support shoulders 224 of the actuator stanchion gate anchorage.

The counterweight assembly 43, shown in FIGS. 12 to 15, is an adjustable assembly wherein its center of gravity can be shifted relative to the axis of the support arm assembly 37. The counterweight assembly 43 is composed of a counterweight mounting plate 44 to which multiple tabular weight segments are selectably added. The combination of weights is selected to approximately counterbalance about the rotational axis of support arm structure 37 the weight of the combined gate assembly 75 and the other rotating components attached to and including support arm assembly 37.

Counterweight mounting plate 44 is a welded assembly symmetrical about the vertical midplane of the gate assembly 75. The counterweight mounting plate 44 has a rectangular base plate having two symmetrically positioned holes and three vertical slots cut out of the base plate. The cutout holes are dimensioned to accommodate the passage of the rear arm ends of arm structure 38 of support arm assembly 37 with a close slip fit. The three vertical slots are used for mounting the clamp bolts, wherein one slot is centrally positioned and the other two slots are symmetrically placed about the vertical midplane of the base plate.

In addition, the base plate has short rectangular guide tubes 45 mounted on the forward face of the base plate. Each guide tube is positioned normal to the plate surface and symmetrical about one of the cutout holes in the rectangular plate. The guide tubes 45 are designed to provide ample clearance for the insertion of the rear arm tubes of arm structure 38. On the forward end of each of the guide tubes 45, parallel to the mounting plate, is welded a thick rectangular plate block having a central cutout hole dimensioned to provide a close fit for the rear arm tubes of arm structure 38. The cutout hole in the thick plate block is aligned with the corresponding cutout hole in the base plate.

Furthermore, the upper end of each thick plate block has a drilled and tapped hole in its forward face into which a threaded rod segment 46 is screwed so that it projects forward from the assembled counterweight mounting plate 44. When the counterweight mounting plate 44 is mounted in place on the rear arm tubes of arm structure 38, the thread rods 46 extend through the holes in the counterweight anchor points 39. Two threaded rod nuts 47 are mounted on each threaded rod 46 straddling the counterweight anchor point 39 so that the position of the counterweight mounting plate 44 is adjustable.

A suspender 48, a rectangular bar which is machined so that it has an "L" shape when viewed normal to the midplane of the gate assembly, is positioned horizontally and with its axis normal to the top edge of the base plate of the counterweight mounting plate 44 so that it is symmetrically placed and welded above each of the cutout holes in the base plate. The cutaway portion of the suspender is positioned on the lower rear side of the base plate so that the vertical transverse side of the suspender is flush with the rear face of the base plate. An oversized vertical clearance hole for mounting a suspender screw 51 is drilled through the thinned portion of each suspender 48 at a fixed distance from the rear face of the base plate. For each rear arm tube passage in the counterweight mounting plate 44, a gusset plate is used between its associated guide tube 45, the thick plate block, the suspender 48, and the base plate to stiffen and strengthen the assembly.

The counterweight plates 52*a,b,c* are rectangular plates made with appropriate thicknesses to permit easy handling. Multiple similar counterweight plates 52 are preferably used, such as the three counterweight plates 52*a,b,c* shown in FIG. 13. However, only one counterweight plate 52*a* is required. The remainder of any required weight can be supplied in the form of easy-to-handle plates or blocks, smaller than plate 52*a*, which are rigidly fixed to counterweight plate 52*a*. Here only the arrangement shown in FIGS. 12 to 15 is described.

Counterweight plates 52*a,b,c* are symmetrical rectangular plates with approximately the same dimensions, other than thickness, as the base plate of the counterweight mounting plate 44. At the same lateral offset from the vertical midplane as the cutout holes in the base plate of counterweight mounting plate 44, two vertically elongated slots are cut in the plates 52*a,b,c* for clearance of arm structure 38. Likewise, an identical array of symmetrically placed through interplate clamp holes 54 is made in each of the plates 52*a,b,c*, but the holes are tapped in the plate 52*a* for interplate clamp screws 55, while the holes in plates 52*b,c* are clearance holes for screws 55. The counterweight plates 52*a,b,c* are aligned and clamped together using one interplate clamp screw 55 for each clamp hole 54 of the array. Additionally, each of the plates 52*a,b,c* is provided with a second array of holes to provide through clearance for clamp bolts 49. The holes for the clamp bolts 49 are placed in three vertical rows that are two holes high. The rows are placed with one vertical row on the vertical centerline and two other rows at the same lateral offset from the vertical midplane as the outer slots in the base plate of counterweight mounting plate 44. The maximum vertical separation of the two holes in a vertical row for this second array is equal to the length of the slots in the counterweight mounting plate 44 base plate minus twice the range of vertical adjustment desired for the counterweight plates 52*a,b,c*. The height of the center of the second array of clamp bolt holes in plates 52*a,b,c* is the same as the height of the middle of the slots in the counterweight mounting plate 44, with both heights measured relative to their respective plate midheights. Clamp bolts 49 extend through their mounting holes in counterweight plates 52*a,b,c* and thence through the slots in the counterweight mounting plate 44. Nuts 50 screwed onto the ends of bolts 49 clamp plates 52*a,b,c* to plate 44.

On the upper horizontal face of each of the counterweight plates 52*a,b,c* are positioned two vertical drilled and tapped holes 53 for engaging the suspender screws 51 of the counterweight mounting plate 44. These vertical holes 53 have the same offset from the vertical midplane of their counterweight plate as do the holes in the suspenders 48 which are used to mount the suspender screws 51. The offset to the rear of these tapped holes is the same as the offset of the screw holes in the suspender 48 from the rear face of the counterweight mounting plate 44.

Arm box 150, shown in FIGS. 16 to 20, is a weldment rigidly mounted between the forward arms of the support arm assembly 37. The width of the arm box 150 corresponds to the gap between the parallel arms of the support arm assembly 37. The arm box serves to align and support the gate assembly 75 until the gate is impacted by a vehicle. At such a time the gate is released by the rupture of shear pins and henceforth is then supported on its actuator end only by the engagement of the crossbars 83 of the inner arm end piece 82 engaged with the actuator stanchion gate anchorage 219.

Figure 17:
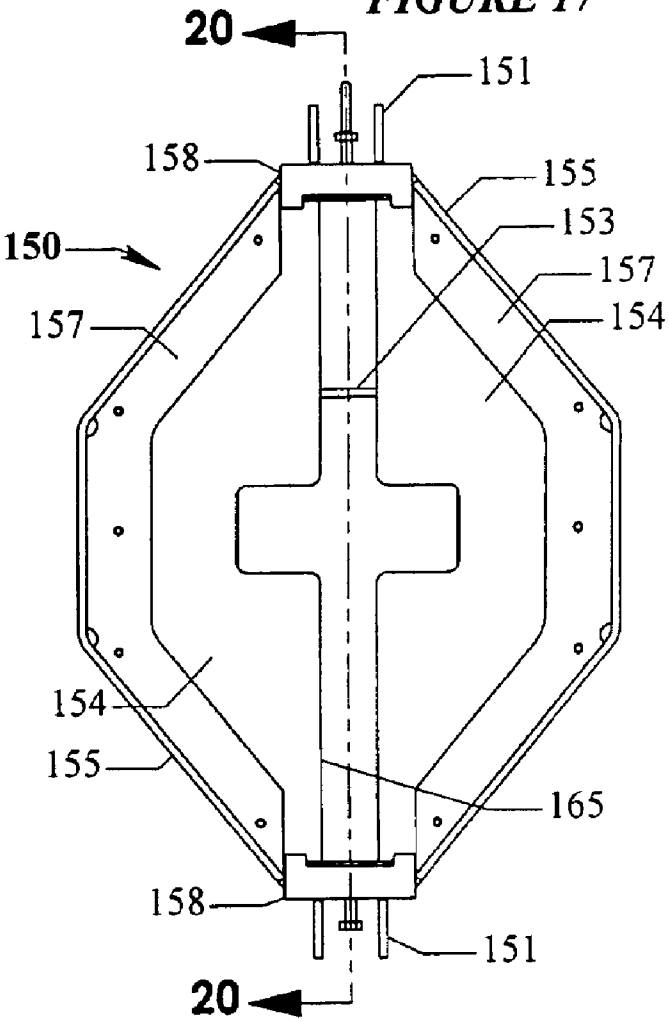
FIG. 17 is a profile view on the arm side of the arm box assembly along the axis of symmetry of the arm assembly.
Figure 16:
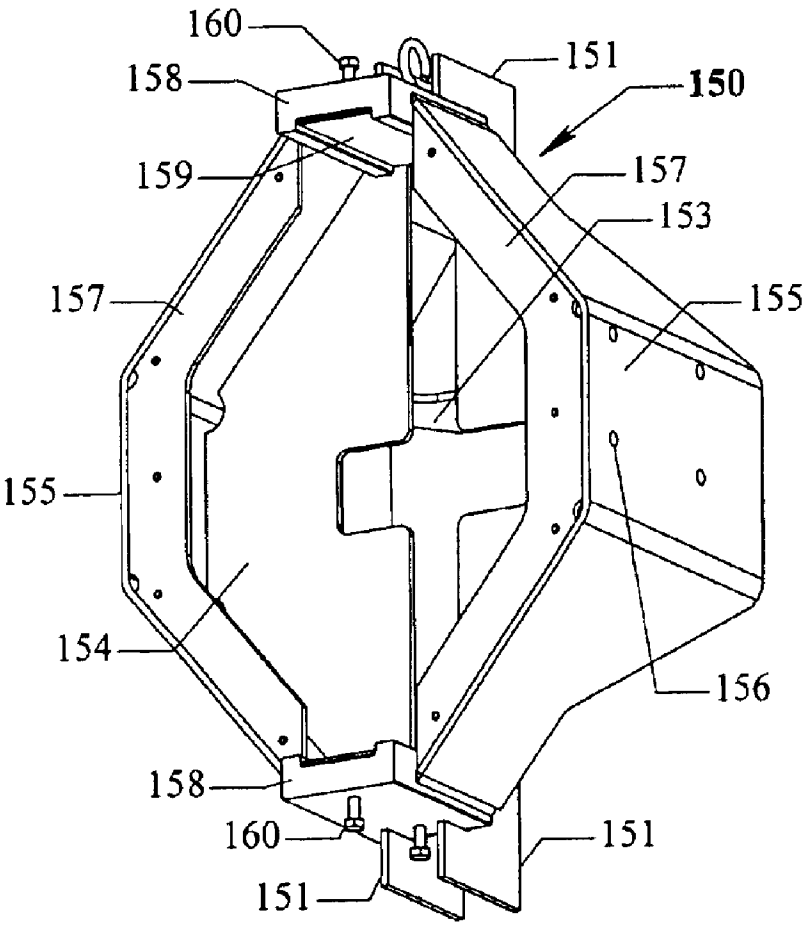
FIG. 16 is an oblique view from the arm side of the arm box assembly.

The arm box 150 has a doubly symmetric approximately diamond shaped polygonal profile when viewed along the axis of the gate assembly 75 as seen in FIG. 17. Referring to FIGS. 16 and 17, the arm mount channels 158 are two identical rectangular cross section bars which have symmetry about their vertical midplanes and longitudinal grooves on their inside faces. The arm mount channels 158 are located at the top and bottom sides of the polygonal profile of the arm box. Two or more vertical drilled and tapped holes are positioned on the vertical midplane and spaced down the length of the arm mount channels. The width of the grooves in the arm mount channels 158 is slightly more than the width of the outer tube 77 chords of the outside gate sections 76 of the gate assembly 75. The vertical depth of a groove is equal to approximately two or three times the thickness of the rectangular pressure plate 159 that is a close fit within the groove and mounted therein. Pressure screws 160 are threaded into the holes in the arm mount channels 158 and used to apply inward loadings to and positioning for the pressure plates 159. When the pressure plates 159 are positioned in the grooves of the arm mount channels 158 and the pressure screws 160 are backed off, the distance between the inside faces of the pressure plates is approximately 0.25 inch to 0.375 inch more than the vertical height of the outside gate section 76.

Figure 19:
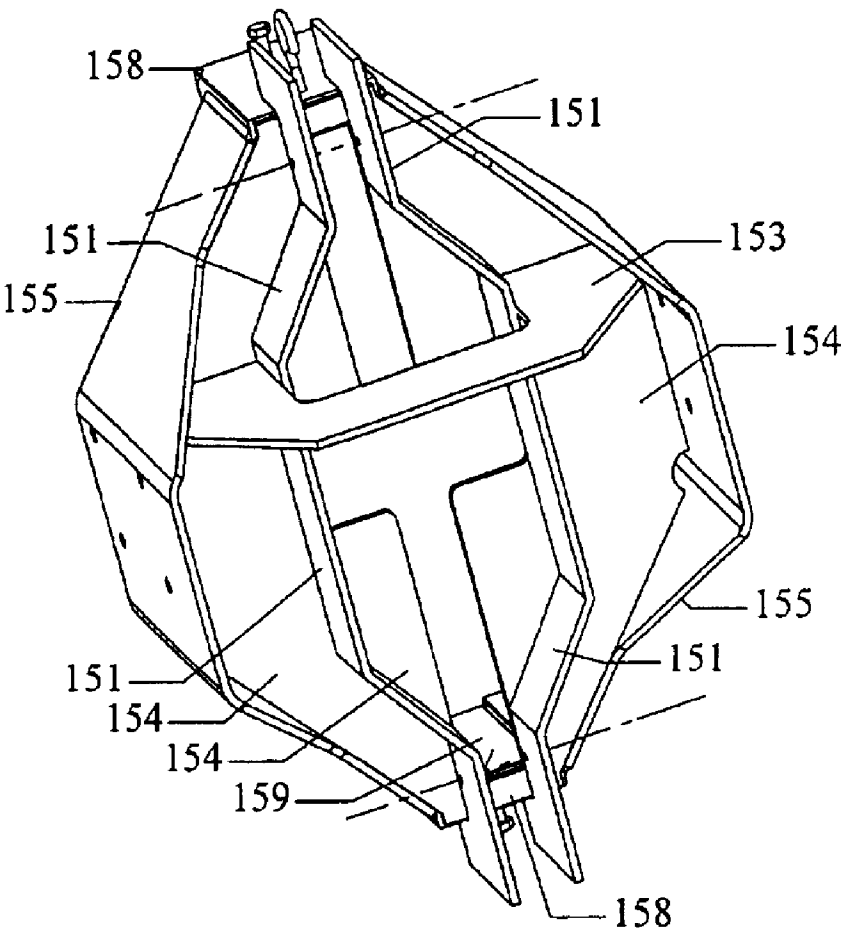
FIG. 19 is an oblique view from opposite the gate assembly side of the arm box assembly.
Figure 18:
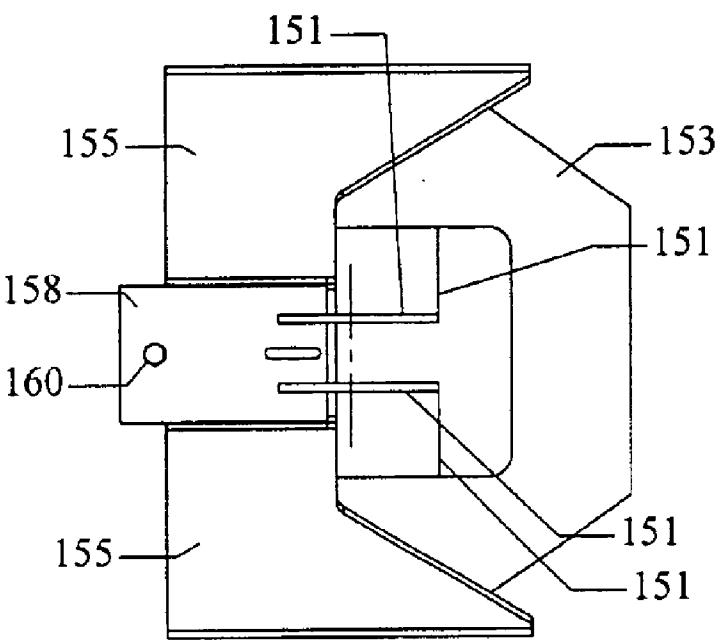
FIG. 18 is a plan view of the arm box assembly.
Figure 20:
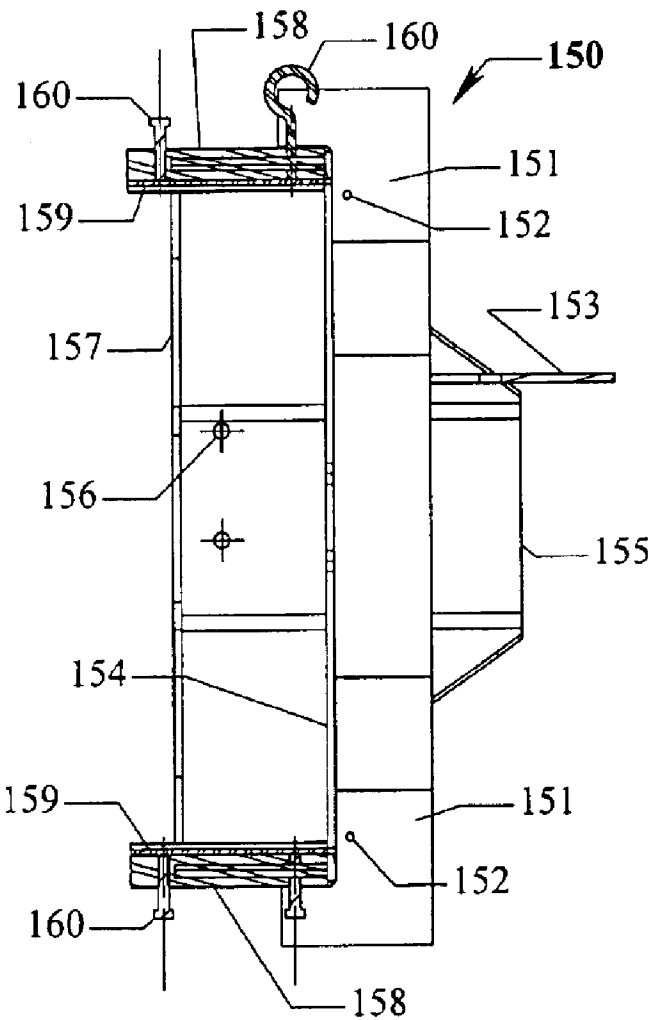
FIG. 20 is a vertical sectional view taken on the centerline of the arm box and corresponding to line 20—20 of FIG. 18.

Mirror image vertical brace plates 151, seen best in FIGS. 19 and 20, have symmetry about their horizontal midplane and are narrow plates with rectangular upper and lower tabs projecting toward the roadway 11. The upper and lower tabs are coplanar, but the midsection of plates 151 is offset to the outside parallel to the upper and lower tabs.

Shear pin mounting holes 152 are drilled in the upper and lower tabs of vertical brace plates 151. Corresponding shear pin holes 85 are match drilled in the inner end arm end piece 82, so that the shear pins 163 can be inserted through the tabs and into the inner end arm end piece 82 of the gate assembly 75 following assembly.

Transverse diaphragm plate 154 provides the outline of the polygonal shape of the arm box and is welded to the outside end of the arm mount channels 158 transverse to the vertical midplane of the gate assembly 75 to control the spacing between the channels. A central cruciform clearance hole 165 is symmetrically located in the middle of the transverse diaphragm in order to permit the arm end piece 82 to readily shift in and out of the arm box 150 past the transverse diaphragm plate 154. The vertical brace plates 151 are positioned in a mirror image pattern and welded both to the outside face of the transverse diaphragm 154 and to the outside horizontal faces of the arm mount channels 158. The spacing between the vertical brace plates 151 provides a close slip fit to the main body of the arm end piece 82.

Mirror image side plates 155 extend outwardly away from the roadway 11 from the inside transverse plane at the front of the arm box 150. Side plates 155 are press-broken so that their shape conforms to the outside of the nonhorizontal sides of the polygonal shape of the arm box profile. The side plates 155 are welded on their interior intersection with the transverse diaphragm 154 and also welded at their horizontal upper and lower longitudinal edges where they abut the arm mount channels 158. Bolt holes 156 corresponding to those on the forward ends of the arm structure 38 are provided in the side plates 155 so that the arm box 150 can be bolted to the support arm assembly 37 with arm box mounting bolts 161 and nuts 162.

A "U"-shaped horizontal brace plate 153 abuts the rear face of the transverse diaphragm 154 and extends from one side plate 155 inside face to the corresponding face of the other side plate. The horizontal brace plate 153 is welded at its intersections with plates 155 and 151. Narrow mirror image front reinforcing plates 157 match the outline of the nonhorizontal edges of the polygonal profile of the arm box 150, but do not extend all the way to the upper and lower arm mount channels 158. The front reinforcing plates are symmetrically positioned and welded inside the side plates 155 at the inside transverse plane of the arm box 150. The forward end of the arm box 150 is open to permit access for assembly to the support arm assembly 37 and to further permit the gate assembly 75 to be moved into the arm box.

Figure 27:
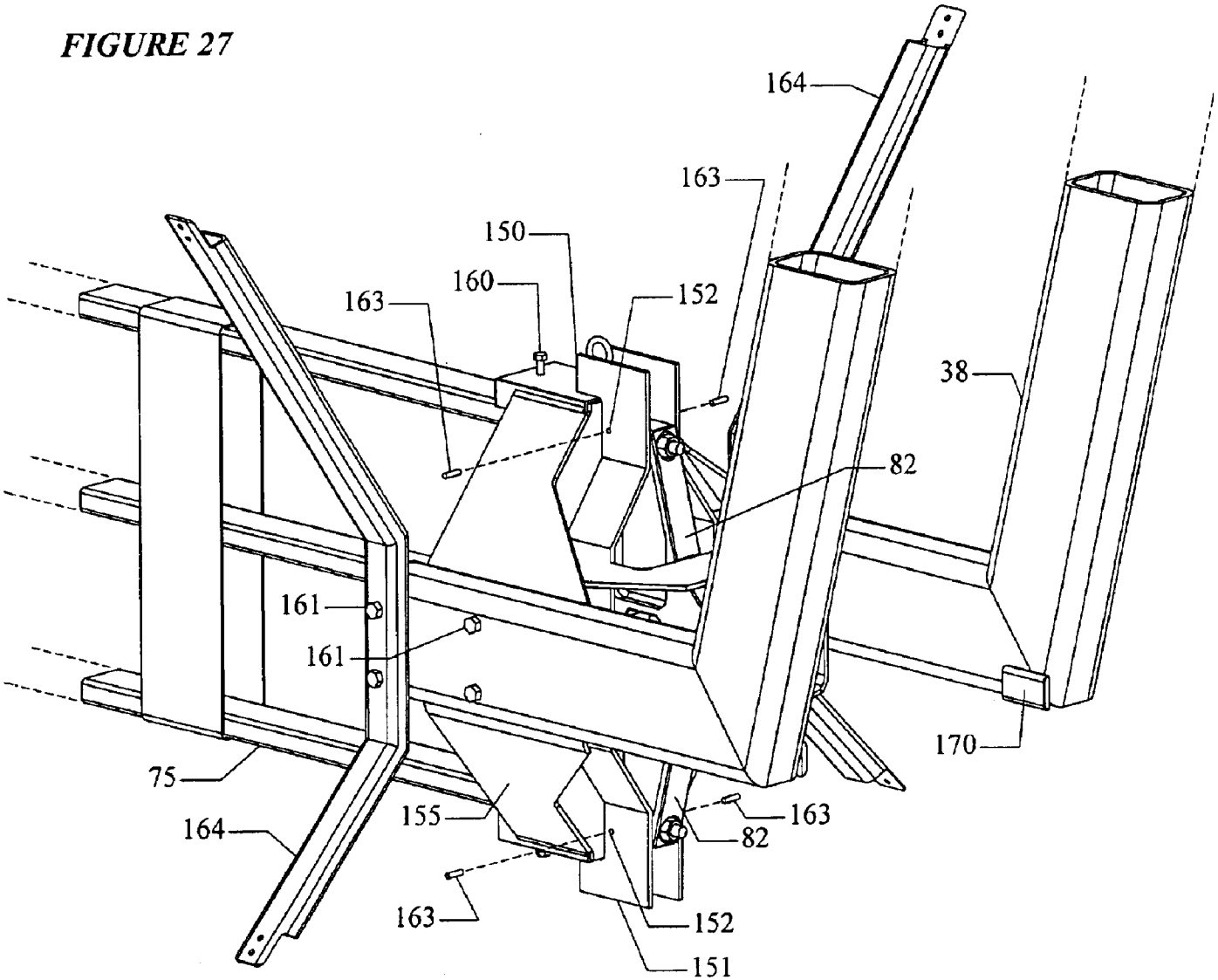
FIG. 27 is a partial oblique view of the assembled arm box assembly with the gate assembly mounted therein, the wind brace arms, and the inner end of the arm assembly.
Figure 28:
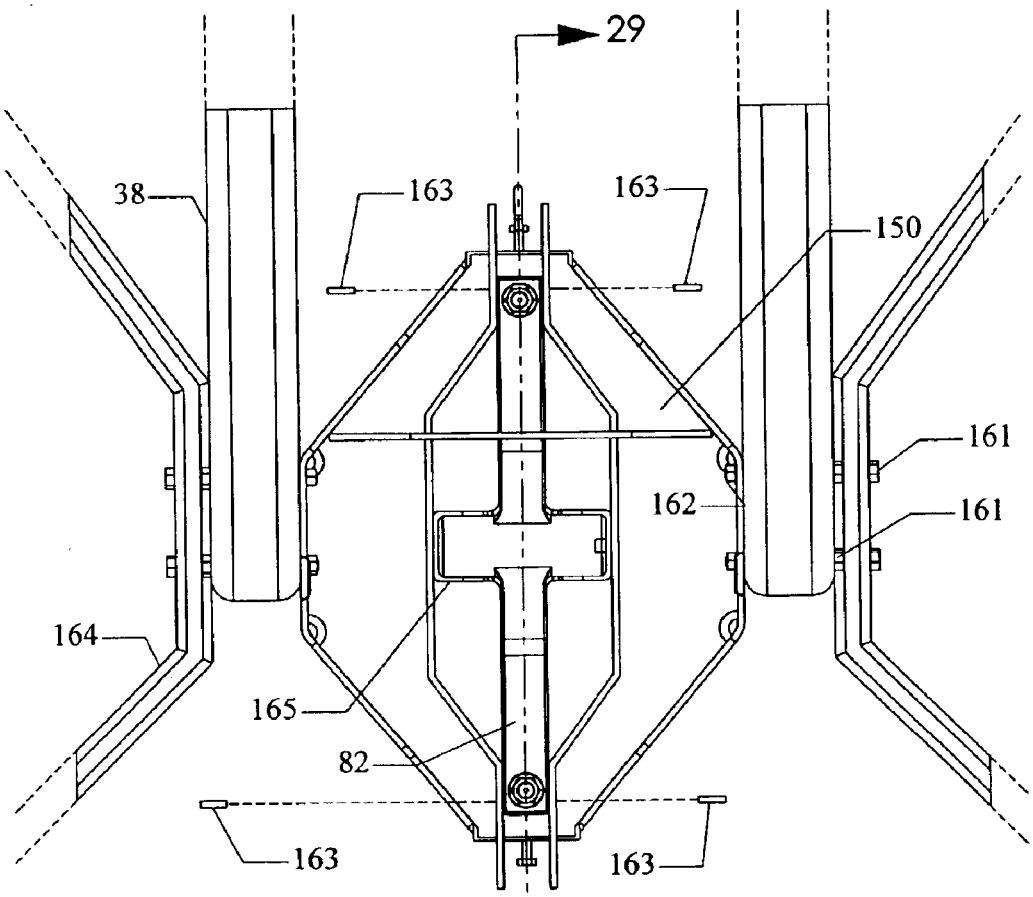
FIG. 28 is a rear profile view corresponding to that of FIG. 27 showing how the gate assembly is fitted into the arm box.

Wind stay support arms 164 are formed from structural rectangular tubing which has upper and lower arms bent outwardly from the central section in the plane transverse to the midplane of the gate assembly 75, as seen in FIGS. 27 and 28. The upper and lower ends of the wind stay support arms 164 have three sides of the tube trimmed off so that the remaining end tab projection is a flat parallel to the longitudinal axis of the gate assembly 75. One or more mounting holes are provided in each tab projection for the eccentric mounting of wind stay cables 100. The central portions of the wind stay support arms 164 have two horizontal holes located in the plane transverse to the midplane of the gate assembly 75 and on the same pattern as the inside mounting bolt holes 156 of the arm box 150. The wind stay support arms are mounted outside the arm tubes of the support arm assembly 37 by the inside pairs of arm box mounting bolts 161.

Shaft 57 is either a solid or hollow cylindrical bar with a male spline at one end. The shaft is mounted coaxially with the rotational axis through the transverse holes in the arm structure 38 of the support arm assembly 37 and also coaxially with the shaft bearings 35 at the upper end of the support arm bracket 33 of the actuator head 17. The diameter of the shaft 57 is selected so that it can be rigidly supported for free rotation in shaft bearings 35. The shaft 57 is rigidly fixed against rotation or translation to the transverse holes in the arm structure 38 where it passes through the reinforcing rings. This may be done by either using a shaft clamp bushing 58 which is a screw activated compression coupling such as a Zero-Max® model ETP Classic® or by means of a wedging bushing. The Zero-Max® coupling is available from Zero-Max, Inc., 13200 Sixth Avenue North, Plymouth, Minn. 55441. The wedging compression coupling would be of the type commonly used to attach sheaves to shafts and would react mutually against both the shaft 57 and the reinforcing ring on the hole in arm 38. The details of both types of connection are not shown herein, but are well understood by practicing designers.

Referring to FIGS. 21 and 22, the actuator mounting bracket 63 has a section of rectangular tubing with a transversely mounted plate arm carrying a ring shaped mounting boss laterally offset from the axis of the rectangular tubing. A concentric shaft hole is provided in both the mounting boss and the plate arm, and a bolt hole circle for mounting the actuator 62 is provided on the mounting boss. A rectangular array of horizontal bolt holes corresponding to the tapped hole array in the rear vertical transverse plate of support arm bracket 33 permits the actuator mounting bracket 63 to be mounted to bracket 33 by actuator bracket mounting screws 65.

Actuator 62 is typically a quarter-turn valve actuator or other suitable type of rotary actuator having a female output drive spline which is mated with the male spline of shaft 57 so that the gate arm assembly 75 can be selectably rotated to either its up or down position. Actuator 62 is mounted to the mounting boss of the actuator mounting bracket 63 on the outside by means of actuator mounting screws 64 engaging the bolt hole circle of the mounting boss and corresponding tapped holes in the actuator mounting boss. The female spline of the actuator 62 is engaged with the male spline on the end of shaft 57 so that the shaft and its attached support arm assembly 37 can be driven.

Controls box 66, also mounted to the vertical transverse back plate of support arm bracket 33, typically is a standard NEMA 4 weather-proof electrical box. Controls box 66 contains microprocessor control circuitry which can be used to selectably operate the actuator 62 to effect the desired motion in the gate arm assembly 75.

Gate arm assembly 75 consists of a segmented welded tubular Vierendiehl truss with special arm end pieces 82 and cable assemblies 92 and 96 mounted interior to the truss stringers. FIGS. 23 through 26 provide the details of the gate arm assembly 75. The gate assembly 75 is composed of two identical outside gate sections 76 and, when required, an inside gate section 86. The length of the outside gate sections 76 is chosen both to facilitate shipping and to correspond to half the required length for a commonly ordered minimum gate length. For longer spans, an inside gate section 86 is provided for mounting between the outer gate sections 76 to provide the required total span for gate assembly 75. For short spans, a single gate section could readily be used. Such a gate would resemble a gate outer section, but with both ends like the outer end of a gate outer section.

The Vierendiehl or undiagonalized truss, used for both the outside gate sections 76 and the inside gate sections 86, comprises horizontal top and bottom outer tube stringers, vertical end pieces, a middle horizontal inner tube stringer, and looped plate tube ties lapped against the external transverse sides of the truss stringers and welded thereto. Truss diagonals are not used in order to simplify framing. Thus, the vertical shear from the weight of the truss is transferred within the panels of the truss between the plate tube ties by bending and shear of the truss stringers.

The Vierendiehl truss used for the outside gate sections 76 is made of horizontal top and bottom outer tube 77 aluminum stringers, a vertical aluminum end tube piece 79 on one end, a rectangular aluminum plate end flange 81 on the other end, a middle horizontal inner tube 78 aluminum stringer, and looped aluminum tube ties 80 adjacent to the external vertical transverse sides of the truss stringers and welded thereto. Typically, bevel joints are used to join the outer tubes 77 to the end tube 79, while butt joints are used for the connections between the inner tube 78 and the end tube 79. Butt joints are also used for connections of both the outer tubes 77 and the inner tube 78 to the end flange 81.

The tube ties 80 are formed of press-broken aluminum plate and are wide relative to their thickness. The ties 80 are either welded into loops or have their ends welded to the same tube so that they form either a complete or a nearly complete loop. The tube ties 80 are regularly spaced along the length of the outside gate arm assembly 76 and serve to space apart and strongly tie the stringers of the Vierendiehl truss together. Clearance holes for cable assemblies 92 and 96 are drilled in the end tube 79 and the end flange 81 coaxial with the stringers 77 and 78 of the truss. Additionally, a regular pattern of mounting bolt holes, with two holes laterally spaced symmetrically from and adjacent to each tube stringer, is provided in the end flange 81.

The Vierendiehl truss used for the inside gate section 86 is composed of horizontal top and bottom outer tube 87 aluminum stringers, two vertical aluminum end flanges 81, a middle horizontal inner tube 88 aluminum stringer, and one or more looped aluminum tube ties 80 adjacent to the external transverse sides of the truss stringers and welded thereto. The tube ties 80 are regularly spaced along the length of the inside gate section 86 and serve to space apart and strongly tie the stringers of the Vierendiehl truss together. Preferably, butt joints are used for connections of both the outer tubes 87 and the inner tube 88 to the end flanges 81. Clearance holes for cable assemblies 92 and 96 are drilled in the end flanges 81 coaxial with the stringers 87 and 88 of the truss. The outside gate sections 76 are assembled with the inside gate section 86 in between by aligning and butting the respective end flanges together and connecting them with bolts 89 and nuts 90 inserted in the bolt holes of the end flanges.

One or more pairs of wind stay cable mounts 99 are mounted on the upper and lower truss chord tubes by clamping so that wind stay cables 100 can be mounted to both the holes provided in the wind stay support arms 164 and the wind stay cable mounts 99 to guy the gate assembly 75. The wind stay cable mounts 99 consist of an outer horizontal plate with outwardly projecting tabs that carry holes for attaching the wind stay cables and an inner horizontal clamp plate. Each tab of the outer horizontal plate is bent away from the mounting plane of the outer horizontal plate at a different angle, so that cables mounted thereon can cross each other without touching and chafing. Both plates have identical patterns of one or more pairs of bolt holes through which bolts can be inserted and tightened with nuts for clamping the mounts 99 to the chords of the gate truss. For each bolt hole pair, one hole is on each lateral side of the truss chord being clamped.

Arm end pieces 82 are rigid fabrications or castings that attach vertically to the ends of the truss of gate arm assembly 75 and serve as a tapered beam to transfer the loads of attached cable assemblies 92 and 96 to the projecting crossbars 83. FIGS. 23, 26, 31, and 33 more clearly show details of this element of the gate assembly 75. The upper and lower ends of arm end pieces 82 have horizontal through holes coaxial with the holes in the end tubes 79 of the outside gate sections 76 of the gate assembly 75. A central horizontal hole, which penetrates from the gate truss side to a central transverse through hole in the arm end piece 82, is positioned coaxially with the central horizontal hole in the end tubes 79. Centrally located and on the other side of the arm end piece 82 from the end tube side are outwardly extending symmetrical horizontal transverse round crossbars 83. A horizontal rectangular section latch notch 84 is centrally located in the outer end of one or both of the crossbars 83. Additionally, four shear pin holes 85 are symmetrically match drilled into the lateral sides of arm end piece 82 at assembly of the gate assembly 75 into arm box 150.

Figure 26:
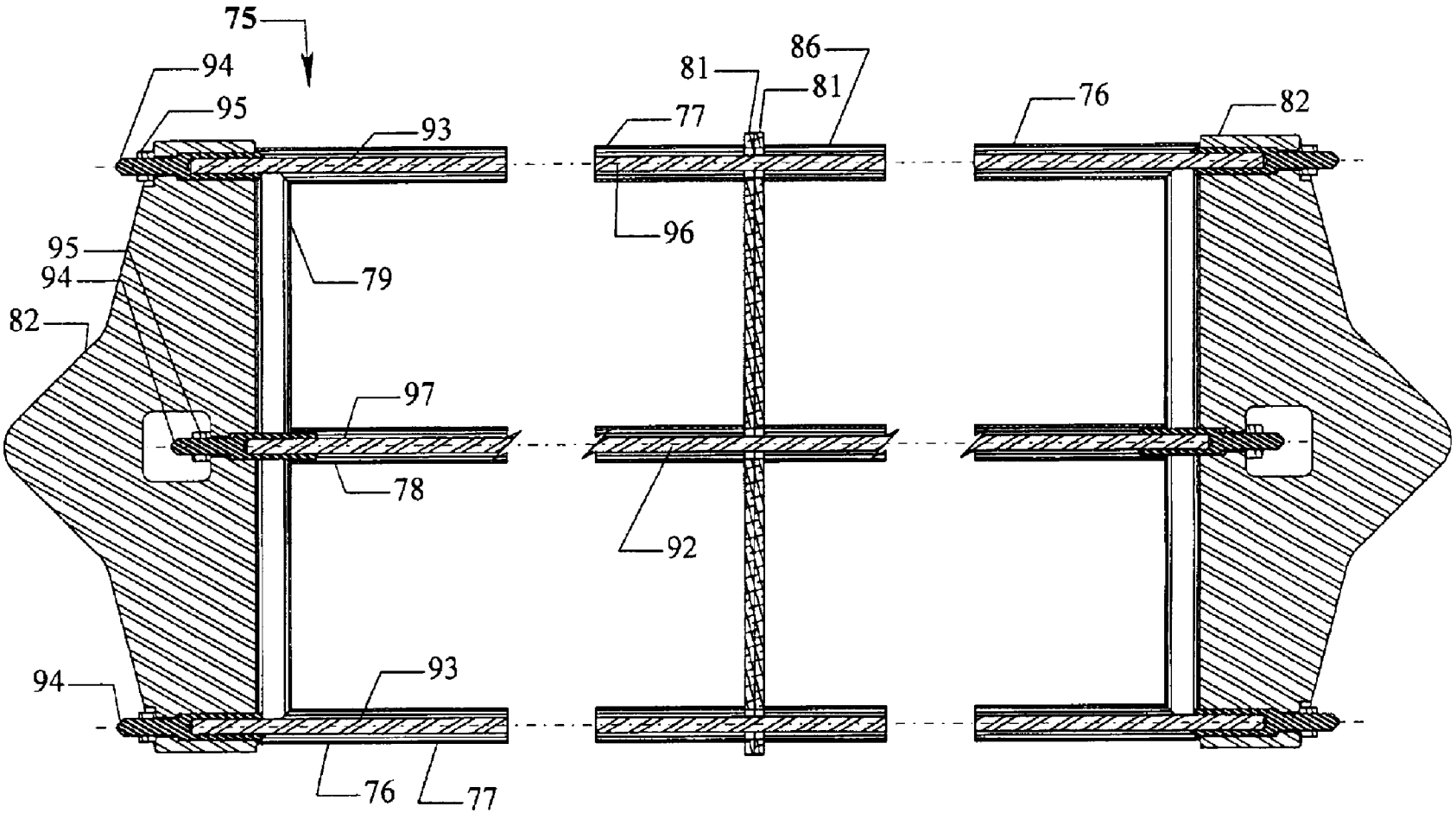
FIG. 26 is a partial longitudinal cross-sectional view of the gate assembly taken on the vertical line 26—26 of FIG. 25.

Outer cable assembly 92 consists of outer cable 93 and a swaged-on externally threaded cable end fitting 94 on each end of the cable 93. Swaged-on threaded cable end fitting 94 is a round member with a male thread at one end and which has a central blind hole into which the cable 93 may be inserted for the making of an externally compressed swaged connection. Similarly, inner cable assembly 96 consists of inner cable 97 and swaged-on cable end fittings 94 on each end of the cable. The cable assemblies 92 and 96, shown in more detail in the longitudinal gate cross-section of FIG. 26, are inserted into their respective holes in the assembled outside gate sections 76 and inside gate section 86 coaxial with, respectively, outer and inner tubes 77, 87, 78, and 88 and then the arm end pieces 82 are comated with the outer ends of the gate assembly 75. A cable tensioning nut 95 is screwed and tightened onto the end of each of the swaged-on cable ends 94 of cable assemblies 92 and 96 extending through the gate assembly 75 and the arm end pieces 82 to retain the arm end pieces in place and rigidize the gate assembly. The completed gate assembly 75, but without its solenoid 98 for latch release and without wind stays 100, is shown in FIGS. 23 to 26.

Figure 29:
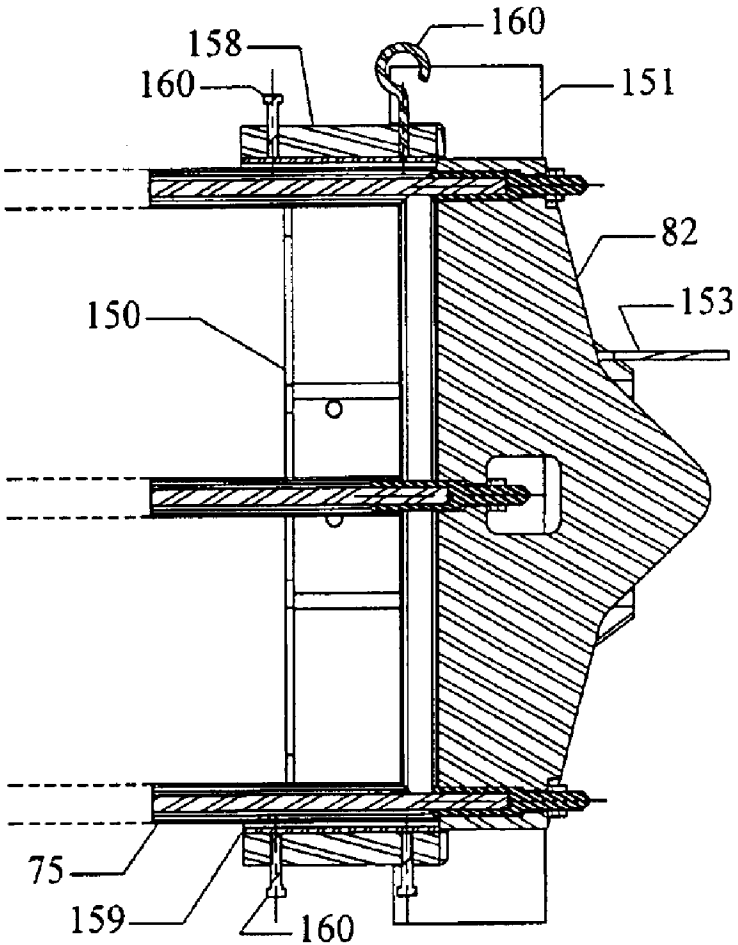
FIG. 29 is a longitudinal vertical cross-sectional view taken along line 29—29 of FIG. 28 and corresponding to FIG. 20, but with the mounted end of the gate assembly positioned within the arm box.

One end of the gate assembly is inserted into the arm box 150 of the operator stanchion 16, as indicated in FIG. 29. The depth of insertion of the gate assembly 75 into the arm box 150 is to the point where the interface between the end tube 79 and the arm end piece 82 is coplanar with the face of the transverse diaphragm 154 away from the roadway 11. At this point, the pressure screws 160 are adjusted to cause the pressure plates 159 of the arm box 150 to firmly bear on the upper and lower faces of the inserted end of the outside gate section 76 of the gate assembly 75. The next step in assembly is to match drill the four shear pin holes 85 in both the upper and lower faces of the inserted and located arm end piece 82 by drilling through the shear pin holes 152 in the vertical brace plates 151 of the arm box 150. FIGS. 27, 28, and 29 show the inserted gate assembly 75 mounted in the arm box 150, while FIGS. 27 and 28 show how the cylindrical shear pins 163 are installed. FIG. 28 shows how the inserted and pinned arm end piece 82 is positioned centered in the cruciform clearance hole 165 of the arm box 150 so that it can be shifted axially in the event of a vehicle impact.

Multiple wind cable stays 100 are symmetrically attached to the wind stay support arms 164 of the operator stanchion 16 on their first ends and to the wind stay cable mounts 99 of the gate assembly 75 on their second ends as seen in FIGS. 2 and 36. These wind stay cables 100 thus serve to guy the cantilevered gate assembly 75 so that it is well supported and stiffened laterally and also, to some extent, vertically. Each wind stay cable 100 is attached to a hole in one of the tabs on the outer horizontal plate of a wind stay cable mount 99 at its first end and then is attached to a corresponding wind stay support arm 164 on the opposite side of the gate vertical midplane. Because the holes in the tabs on the wind stay cable mount are at different heights, the wind stays 100 cross, but do not contact each other. This arrangement avoids cable chafing and wear. The stiffness of a guying arrangement is enhanced when the inclination of the wind stays 100 to the axis of the gate assembly 75 is increased for a given mounting location on the gate. This cross-over of the wind stays effectively increases the stiffness of the gate while minimizing the lateral extension of the wind stay support arms, when compared to the conventional non-crossing guying used on other structures.

Figure 31:
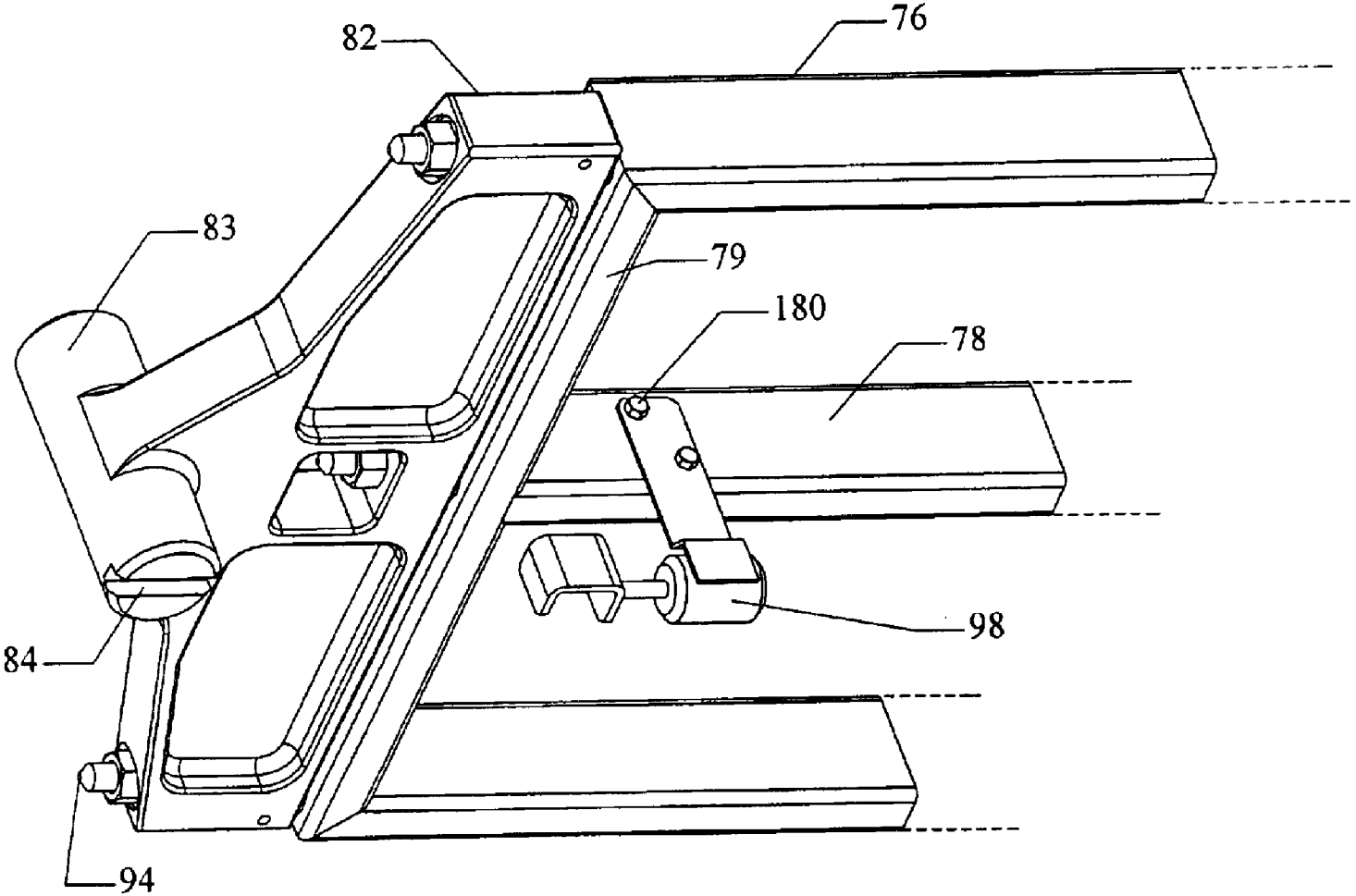
FIG. 31 is an oblique view of the outer end of the gate assembly with the latch release mechanism.

Latch-opening solenoid 98, best seen in FIGS. 30 and 31, is a high-force long-stroke solenoid that has a radially extending integral mounting bracket. Machine screws 180 are inserted through mounting holes in the mounting bracket of the solenoid 98 into match drilled and tapped holes in the top horizontal face of the inner tube 78 of the outer end 76 of the assembled gate assembly 75. The body of solenoid 98 is generally cylindrical with a central cylindrical cavity in which the solenoid plunger and a passive return spring are mounted. When the gate assembly 75 with the mounted latch-opening solenoid is viewed transversely, the outer tip of the solenoid plunger is seen to have an inverted "U"-shaped hook of press broken light gauge metal attached. The solenoid 98 is positioned close to the outer end of the gate assembly and is mounted with its axis approximately colinear with that of latch release guide bushing 125 on the engagement stanchion head 102. The outer downwardly projecting leg of the hook on the solenoid plunger is positioned where it can freely engage the detent of the protruding release bar 142 of the anti-uplift latch. Although it is not shown here for reasons of clarity, dual conductor wiring is run from the controls box 66, along the support arm assembly 37, and out the length of the gate assembly 75 to power the solenoid 98. When power is applied to solenoid 98, it pulls its plunger horizontally towards the operator stanchion, thereby enabling it to pull on the release bar 142 of the anti-uplift latch 131. When power is removed from the solenoid 98, it has an internal spring that causes its plunger to reextend outwardly toward the engagement stanchion 101.

Figure 32:
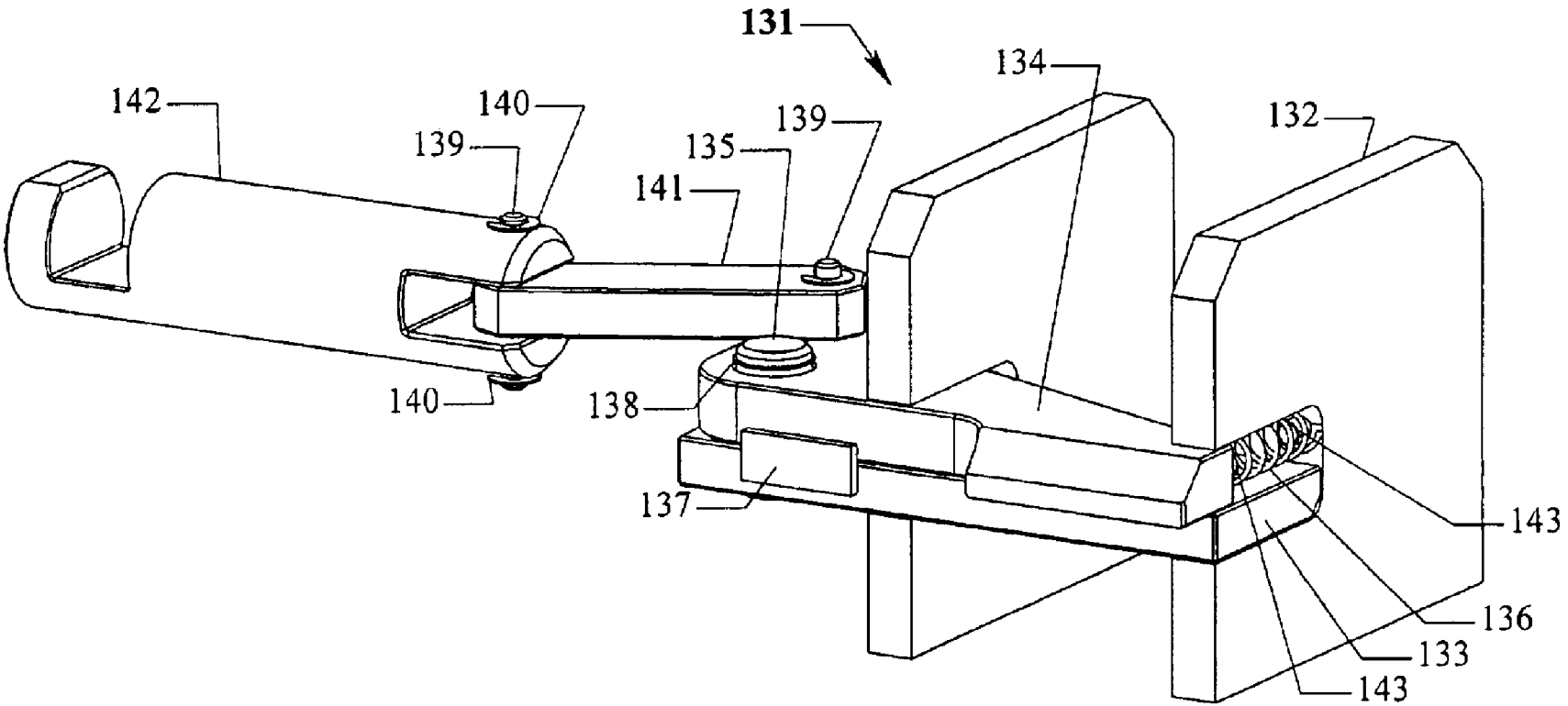
FIG. 32 is an oblique view of the unmounted latching mechanism.

The anti-uplift latch assembly 131 is shown in FIGS. 30 and 32. The latch is mounted by screws from below (not shown) or by welding on top of a side horizontal brace 123 of the engagement stanchion gate anchorage 119 of the engagement stanchion, as seen best in FIG. 30. The latch is located on the same side of the engagement stanchion head 102 as is the latch release guide bushing 125 mounted on the arm guide plate 124 so that it can be accessed by the latch-opening solenoid 98.

The latching operation is based upon a pivotable, spring-biased latch plate 134 passively entering the latch notch 84 on the end of the crossbar 83 of the outer gate arm end piece 82. Unlatching is accomplished by using the solenoid 98 to operate a linkage that causes the latch plate 134 to pivot sufficiently to disengage from the latch notch 84.

Support plate 132 is a rectangular vertical plate with multiple regularly spaced vertical drilled and tapped mounting holes on its lower horizontal surface and a filleted rectangular horizontal notch cut at approximately midheight on its inward (gate) side. The upper corners of support plate 132 are chamfered, and a horizontal blind hole for mounting a short roll pin 143 is located in the transverse vertical end of the notch. The vertical height of the notch is slightly more than the thickness of the latch mount plate 133 and the latch plate 134, described below. Latch mount plate 133 is a rectangular horizontal plate with its width equal to the depth of the notch in the support plate 132 and a large chamfer on its vertical corner on the side away from the gate and toward the roadway 11. A second, smaller chamfer is located on the lower long side away from the gate, and a vertical through hole for the mounting of a pivot pin is positioned at its end adjacent the roadway.

Figure 33:
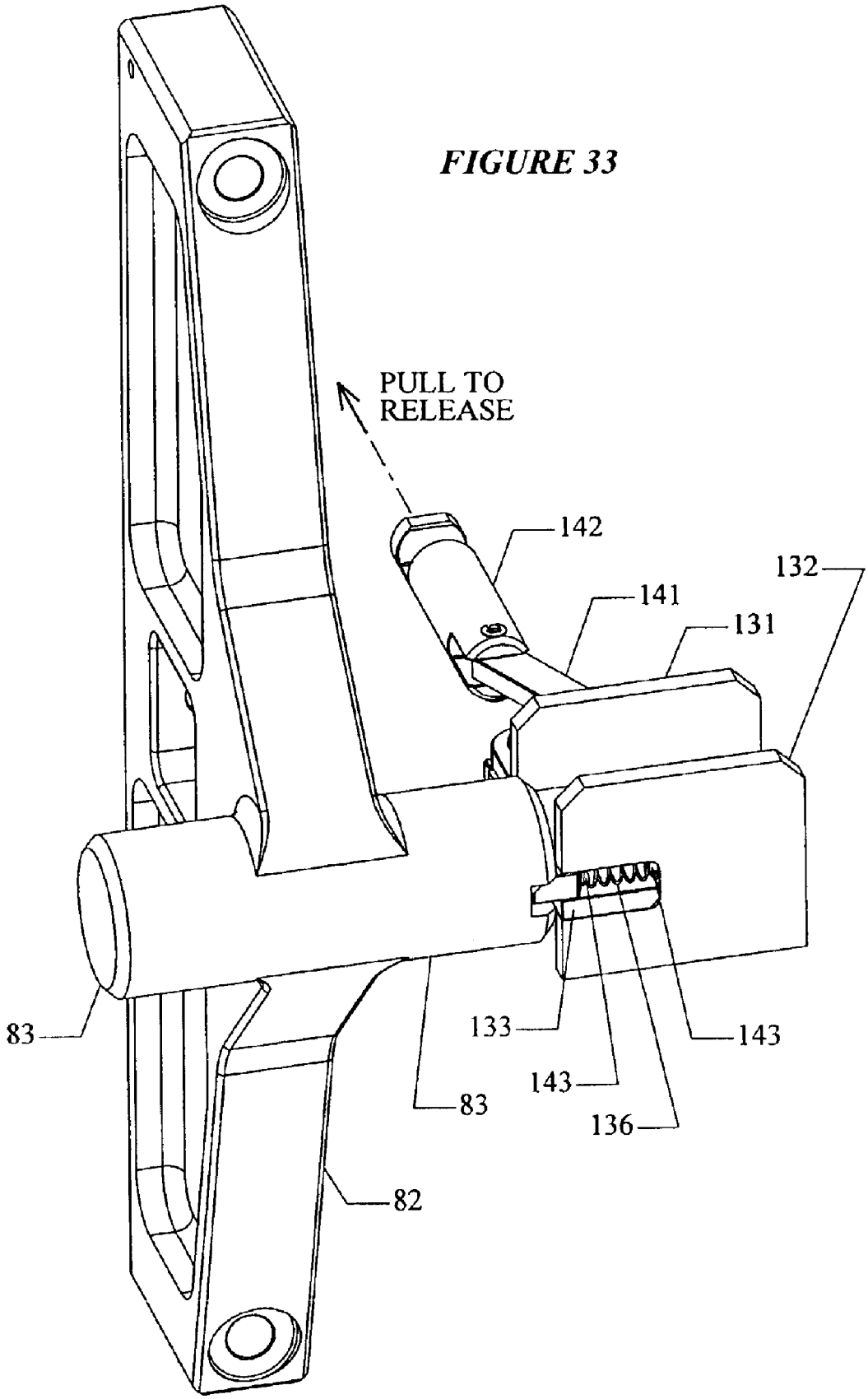
FIG. 33 is an oblique view showing the geometric interrelationship of the gate end fitting and the latch mechanism in a latched relationship.

As seen in FIGS. 30, 32, and 33, two support plates 132 are positioned spaced apart and perpendicular to the adjacent engagement stanchion side gate anchorage plate so that there is a small clearance gap between them and the end of the crossbar 83 when the gate assembly 75 is down. Latch mount plate 133 is mounted in the notches of the support plates 132 on their bottom notch surfaces by welding. The end of plate 133 away from the roadway is positioned flush with the vertical face away from the roadway of the support plate 132 nearest the post 70 of the engagement stanchion 101. The roadway end of the latch mount plate 133 protrudes out beyond the support plate 132 nearest the roadway, while the gate side of plate 133 is flush with the gate side of the support plates 132. A thin rectangular plate tab latch travel stop 137 is welded to the gate side of the latch mount plate 133 close to the roadway side of the support plate away from post 70 of the engagement stanchion 101. The latch travel stop 137 extends above the top of the latch mounting plate 133.

Latch plate 134 has an approximately right triangular shape having unequal side lengths and with a vertical through pivot hole for the mounting of a pivot pin located adjacent its 90° corner. The 90° corner is located at the intersection of the gate side and the roadway side of the latch plate 134, and the pivot hole is offset from the gate side of the latch plate by the same amount as the pivot hole of the latch mounting plate 133 is offset from its gate side. When the latch plate 134 is laid in its normal position on top of the latch mounting plate 133 with the pivot holes of both parts concentric, the latch plate extends to the post end of the latch mounting plate so that it is contained within the notches of the support plates 132 and abuts the latch travel stop 137. Protruding from the gate side of the latch plate 134, starting from the post end of the latch plate, is a rectangular latching projection having a beveled edge on its upward gate side. This projection extends outwardly sufficiently to fully extend into the latch notch 84 of the arm end piece 82 when the gate is closed.

A horizontal axis blind hole for mounting a second roll pin 143 is drilled perpendicular to the gate side of the latch plate 134 on the vertical side directly opposite to the latching projection. A short split roll pin 143 is positioned in each of the horizontal roll pin holes of the latch plate 134 and the post side support plate 132 so that the pins protrude about 3/16 inch. Latch bias spring 136 is a short spiral compression spring which is mounted over the protruding ends of the roll pins 143 so that the latch plate 134 is biased in its latching position against the latch travel stop 137, but the latch plate can be pivoted inwardly by external forces so that there is no protrusion past the gate side of the anti-uplift latch assembly 131.

The pivot pin 135 for the rotational axis of the latch plate 134 is a short cylindrical rod that has a sliding fit with the pivot pin holes of both the latch plate and the latch mounting plate 133. The length of pivot pin 135 is sufficient that it projects enough above and below the assembled pivot pin, latch mounting plate 133, and the latch plate 134 so that its snap ring grooves for retention snap rings 138 are located on the top and bottom of the plate assembly to retain the pivot pin.

At the apex of the latch plate 134, away from the gate and on the roadway side of the triangle of latch plate 134, a projection extends away from the gate and holds a vertical clearance hole for a link pivot pin 139. The position of the link pivot pin hole is such that it is sufficiently spaced away from the vertically chamfered corner of the latch mounting plate 133 that the link bar 141 can be attached there without interference.

Link bar 141 is a chamfered elongated rectangular flat bar which has a vertical pivot hole for accommodating a link pivot pin 139 adjacent each end. Link pivot pin 139 is a short cylindrical rod with snap ring grooves at both ends so that E-Rings 140 can be installed thereto.

The release bar 142 is a round bar that has a diameter which permits a slip fit in the bore of the latch release guide bushing 125 of the engagement stanchion gate anchorage 119. The release bar 142 has a horizontal notch symmetric about its cylindrical axis in its post end to accommodate link bar 141. A vertical hole intersecting the cylindrical axis for mounting a link pivot pin 139 is drilled in the post end of release bar 142 to intersect the horizontal notch there. A rectangular transverse slot is milled adjacent the roadway end of release bar 142 extending from the upper side to approximately 3/8 inch below the cylindrical axis. Additionally, approximately the upper 1/4 inch of the upper surface of release bar 142 between the transverse slot and the roadway end of the release bar is milled away.

The assembly of the anti-uplift latch 131 is completed as follows. Link bar 141 is lapped onto the upper surface of the latch plate 134 with one of its link pivot pin holes concentric with that of the latch plate and a link pivot pin 139 is inserted and retained with one E-Ring 140 above and another below the lapped plates. The other end of link bar 141 is inserted into the post end horizontal notch of the release bar 142 and a second link pivot pin 139 is inserted into the comated link pivot pin holes in the two parts. The second link pivot pin 139 is also retained with two E-Rings 140 above and below release bar 142. The anti-uplift latch 131 is then located on and attached to its side horizontal brace plate 123 with the release bar inserted through the latch release guide bushing 125 of the engagement stanchion gate anchorage 119. When this assembly is done, the transverse slot of the release bar 142 is facing upwardly and extended beyond the latch release guide bushing 125 on the roadway side of the arm guide plates 124 of the engagement stanchion gate anchorage 119.

OPERATION OF THE INVENTION

The counterweight assembly 43 is readily adjusted to ensure that the center of gravity of the assembled rotating components of the crash barrier 10 can easily be operated by the actuator 62. The counterweight adjustment is done as follows as part of the initial setup of the gate. After the operator and engagement stanchions 16 and 101 are installed and the gate assembly 75 is fully mounted in the arm box 150, the gate is placed in its closed position.

A predetermined set of counterweight plates 52 is already installed so the rotating components are reasonably close to balancing about the shaft 57 of the actuator head 17. The thread rod nuts 47 mounted on the thread rods 46 of the counterweight mounting plate 44 are used to adjust the position of the counterweight mounting plate relative to the counterweight anchor points 39 mounted on the arm structure 38 of the support arm assembly 37. This moves the center of gravity of the rotating components in the X direction shown in FIG. 15. When the rotating components are sufficiently close to balance in the X direction, the gate can be moved readily manually within the constraints permitted by the slack in the drive gearing of the actuator 62, thereby indicating adequate balance. The gate is then raised to its vertical position and then the clamp nuts 50 are loosened so that the counterweight plate 52*a* is not clamped to the counterweight mounting plate, but is loosely suspended from it. The counterweight plates 52 are then shifted in the Y direction shown in FIG. 15 by adjusting suspender screws 51 until the rotating components are sufficiently close to balance. If desired, thread rods and nuts can be used instead of suspender screws 51 to ease two way adjustment, but starting with the counterweight plates 52 in their lowest position makes this unnecessary. Adequate closeness to the Y direction balance point is detected in the same way as for the X direction. The counterweight plates 52 are then reclamped to the counterweight mounting plate 44 and the balancing operation is complete.

In normal opening and closing operation the crash barrier 10 functions as follows, assuming that the gate is open with the gate assembly fully elevated, as is shown in FIG. 2. The controls in controls box 66 are selectably activated by human operator signal to start rotation of the quarter-turn actuator 62. As a consequence, the motion of the actuator drive head is imparted to shaft 57 through the splined connection. Since shaft 57 is fixed to support arm assembly 37 by shaft clamp bushings 58 and gate assembly 75 is in turn mounted to the support arm assembly by means of the arm box 150, the arm is gradually lowered into place to extend across and block the roadway 11. As the final portion of the lowering takes place, wind-induced forces or minor structural misalignment may cause gate arm assembly 75 to have deflected out of its vertical central plane. When the deflected gate is sufficiently lowered, outer arm end piece 82 will encounter an inclined face of the arm guide plate 124 and be compelled as it is lowered further to center itself within the gap between the engagement stanchion side gate anchorage plates 120. Further, the crossbars 83 of the outer arm end piece 82 are compelled to move into the pin engagement detents 121. Lowering is stopped when the crossbars 83 bottom out in detents 121.

Figure 34:
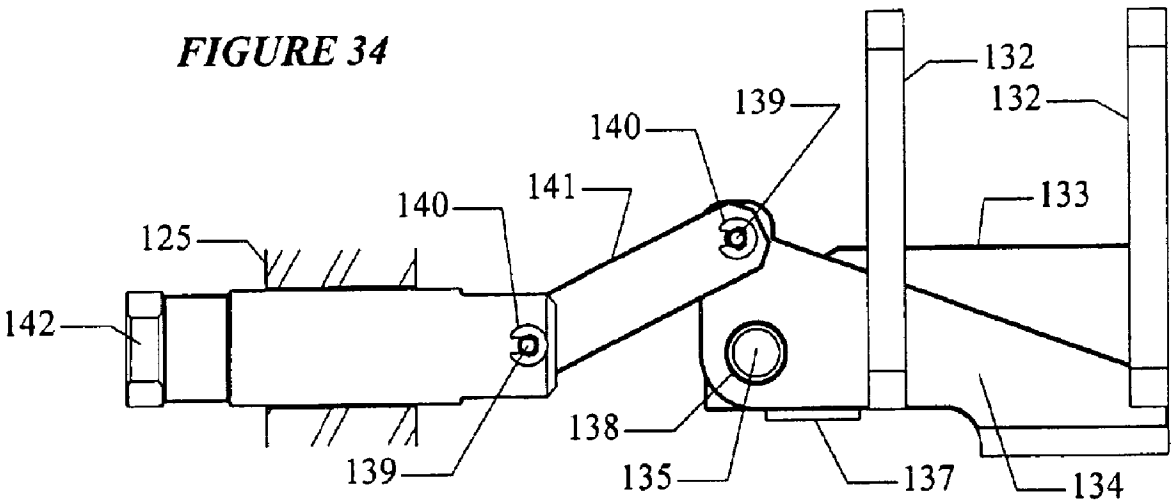
FIG. 34 is a partially schematic plan view of the latching mechanism of FIG. 32 showing the latch plate in a latched position.
Figure 35:
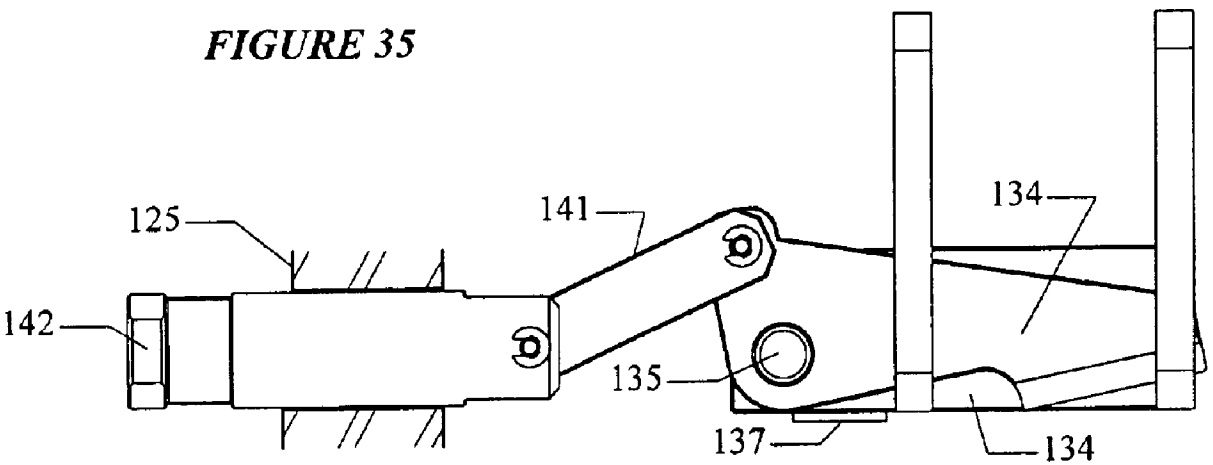
FIG. 35 is a partially schematic plan view of the latching mechanism of FIG. 32 showing the latch plate in a released position.

During this lowering of the gate, the latch plate 134 of the anti-uplift latch 131 is initially extended outwardly toward the vertical midplane of the gate as shown in FIGS. 32 and 34. As the gate is further lowered and the crossbars 83 begin to enter the pin engagement detents 121 of the engagement stanchion gate anchorage 119, the lower external corner of the crossbar 83 on the latch side contacts the extended beveled upper edge surface of latch plate 134 of latch 131. Additional downward travel of the gate then fully deflects latch plate 134 to its position shown in FIG. 35 until the crossbar bottoms out in its pin engagement detent 121 and the latch plate 134 is able to reextend into latch notch 84 in response to the urging of spring 136. Entry of the latch plate 134 into the latch notch 84 thereby locks the outer end of the gate against upward motion in its closed position shown in FIG. 1.

In the event that an uplift force is imparted to the gate assembly 75 and hence the crossbars 83 of the outer arm end piece 82, the latched crossbar can move up slightly as clearance gaps are taken up, but the crossbar is still constrained to remain within pin engagement detent 121 by latch 131, as shown in FIG. 30. When a vehicle impact produces sufficient force to compel crossbars 83 to move into the inward horizontal arm of the "L" of detent 121 and bear on the engagement stanchion side gate anchorage plates 120, the latch 131 remains in contact with the latch notch 84 and in its closed position. No arm guide assembly is required on the operator stanchion side because wind and other deflections are very small on that side. Likewise, it is assumed that there is sufficient inertia in the rotating mechanism of the actuator head 17 that a latch is not required there. However, the same anti-uplift latch 131 could also be applied to engage the inner arm end piece 82 to provide latching for that end of the gate as well.

When it is desired to open the undamaged crash barrier 10, solenoid 98 is activated by the controls box 66 so that the hook on the end of the solenoid plunger is pulled toward the main body of the solenoid. Since the solenoid hook is engaged in the slot of the release bar 142 of the anti-uplift latch 131, the release bar is also pulled toward the solenoid, thereby operating the linkage of the latch assembly to cause the latch plate 134 to disengage from the latch notch 84 of the crossbar 83 of the arm end piece 82. With the latch released, the quarter turn actuator 62 is activated by the controls box 66 to raise the gate from its horizontal latched position to its vertical open position.

When a vehicle impact occurs against a closed gate assembly with the crash barrier 10 in the closed condition shown in FIG. 1, the gate functions as follows. When the vehicle impacts the crash barrier 10 in the gap between the operator stanchion 16 and the engagement stanchion 101, the lateral force against the gate arm assembly may be accompanied by spurious vertical components, so that the retentive action of the anti-uplift latch 131 is required. However, the primary reactions on the stanchions will be horizontal. The gate assembly will bend out of the vertical midplane of the gate under impact and the cable assemblies 92 and 96, housed and protected from cutting within the inside of the gate tubes, will distort along with the gate. Initially, the crossbars 83 of the outer arm end piece 82 will be shifted into full bearing engagement with the engagement stanchion side gate anchorage plates 120 and any slack in the cable assemblies will be removed. After the tension in the cable assemblies increases sufficiently to shear the pins 163 holding the inner arm end piece 82 in the arm box 150, the crossbars of the inner arm end piece will also engage their respective actuator side gate anchorage plates 220. These impact induced tensile reactions in the cables 93 and 97 are transferred to the swaged-on cable ends 94 and thence to the cable tensioning nuts 95, to the arm end pieces 82, and finally through the crossbars 83 to the gate anchorages 119 and 219. Because the transverse strength of the aluminum truss of the gate is relatively weak, the truss is readily bent and distorted by the vehicle. The primary resistance to the vehicle is due to the cable assemblies 92 and 96, which convert the kinetic energy of the vehicle into primarily energy of distortion of the metal structure of the cables. This distortion of the cables takes the form of a permanent plastic elongation of the cables, which are typically constructed of annealed 300 series stainless steel. The function of the aluminum truss of the gate during the impact is twofold: first, the aluminum tubing serves to sleeve and protect the cables from cutting by sharp corners on the vehicle, and secondly the tube ties 80 are sufficiently strong that they prevent the vehicle from forcing its way through the gate arm assembly between or under the cables and compel the cables to function jointly, rather than having the energy absorbed by only one or two cables.

Initially, the angle of inclination of the cables 93 and 97 relative to the vertical midplane between the stanchions is small, so that the vector force component in the direction opposite to the vehicle motion of their tensile forces due to stretching is small. Because the cables behave fairly uniformly along their length during the stretching attendant with the vehicle travel into the gate, the stretching is distributed along the length of the cable. Since the annealed 300 series stainless steel of the cable is strongly work-hardening as a function of strain, when an increment of the length of a cable plastically stretches, it becomes more resistant to stretch, thereby compelling the other sections of the cable to further stretch in order to equalize the cable tension along its entire length. As the vehicle travels farther into the gate, the angle of the cables at the stanchions relative to the vertical midplane between the stanchions also increases, along with the force on the cables. As this change in geometry occurs, the resistance applied to the vehicle increases significantly so that the vehicle is decelerated more strongly the further it travels. Eventually the vehicle is fully decelerated so that it is stopped. The size and number of cables is chosen to permit stopping a desired size of vehicle without cable breakage. This is basically done by ensuring that there is a sufficient capacity of the cables to absorb energy by permanently plastically stretching within the span between the stanchions. The rate of deceleration of the vehicle will be determined primarily by its mass and initial impact velocity for a given gate span.

At some point during the vehicle impact, the inclination of the cables from the vertical midplane between the stanchions 20 and 101 will be sufficient so that the combined force on the gate anchorage will be sufficiently eccentric from the stanchion vertical axis that the resultant torque (i.e., [anchorage reaction] X [reaction eccentricity]) will be sufficient to shear the shear pins 72 which had been able to maintain the initial alignment between both the engagement stanchion head 102 and its mounting post 70 and the actuator head 17 and its mounting post 70. When the shear pins 72 shear, then the head mounted on that post is free to swivel about the vertical of the post with only frictional restraints. This swiveling action, which more easily occurs because of the use of bearings 31 and 32 on the actuator and stanchion heads 17 and 102, reduces the parasitic side loads on the gate anchorages 119 and 219 and the arm end pieces 82 and the swaged-on cable ends 94. The shear pins 72 are sized to cause this shearing to occur before the critical components mentioned above are permanently deformed by the side loads. During the rotation of the heads 17 and 102, their respective retention bolts 21 help retain the heads on their posts 70.

The crash barrier 10 can be simply refurbished by removing the old gate arm assembly 75, removing the stubs of the sheared shear pins 72 and 163, realigning the heads 20 and 102 relative to their respective mounting posts 70, and then installing new shear pins 72. The new gate arm assembly with new cables can then be inserted into the socket of the gate arm mounting box 45 and mounted as described previously. The strength of the mounting posts 70 and the other components of the crash barrier are selected so that the only portions of the structure damaged by vehicle impact on the gate will be the gate assembly 75 and the shear pins.

ADVANTAGES OF THE INVENTION

One of the advantages of the present invention over previous designs is the limiting of damage during a vehicle impact to the expendable gate assembly 75 and the shear pins 72 and 163. This limiting of the damage is due to robustness of the design and provision of the break-away rotational feature of the mounting of the actuator head 17 and the engagement stanchion head 102. The resultant avoidance of collateral damage to the balance of the crash barrier permits a rapid, inexpensive refurbishment of the crash barrier 10 after a vehicle impact. In the event of a much more energetic impact than the design level for the crash barrier, the cables will part before the other components are permanently damaged.

The modular construction of the crash barrier facilitates replacements and refurbishment. Additionally, the use of the press-broken plate tube ties 80 around the truss horizontal stringer tubes housing cable assemblies 92 and 96 provides a very strong but inexpensively fabricated means of constructing the gate arm assembly 75. The use of threaded swaged-on cable ends 94 permits easy gate arm installation and replacement. The initial threading of the cables through the tubular truss stringers 81 and 82 is also simplified by having the swaged-on cable ends present. Since the swaged-on cable ends are threaded and hence readily adjust for length variations by turning the cable tensioning nuts 95, cable length tolerances during fabrication are not as sensitive.

The provision of the simply controlled anti-uplift latch assembly significantly enhances the overall reliability of the crash barrier. In addition, the latch can be manually shifted to permit gate opening in the event of a solenoid malfunction.

The ease with which the counterweight balance adjustment for the rotating assembly can be changed simplifies field operations.

The cross-over of the wind stays enhances lateral stiffness of the gate assembly while limiting the lateral extension of the wind stay mounting structures.

Although the present invention and its advantages have been described in detail, it should be understood that various changes, substitutions and alterations can be made herein without departing from the spirit and scope of the invention as defined by the appended claims.

What is claimed is:

1. A crash barrier comprising:

(a) a gate, wherein the gate comprises:

(i) at least one gate section having:

(aa) a first and a second end, (bb) at least two vertical structures having a number of vertically spaced apart apertures, wherein the number and spacing of the apertures are substantially equal on the two vertical structures and wherein one vertical structure is positioned at the first end of the gate section and the other vertical structure is positioned at the second end of the gate section, (cc) a number of cable tubes, wherein the number of tubes is equal to the number of apertures in the vertical structures, the cable tubes extending substantially horizontally between and attached to the vertical structures such that an interior of each cable tube is aligned with one aperture in each of the vertical structures, and (dd) a plurality of tube ties spaced apart along the length of the cable tubes, wherein each tube tie is attached to at least two sides of each cable tube, (ii) an operator end piece mounted at an operator end of the gate, (iii) an engagement end piece mounted at an engagement end of the gate, and (iv) a plurality of substantially parallel spaced apart cables extending substantially horizontally from the operator end piece to the engagement end piece, wherein each cable is surrounded by one cable tube as the cable extends across each gate section and wherein each cable is anchored to the operator end piece and the engagement end piece;

(b) an operator stanchion on one side of a roadway for raising and lowering the gate, the operator stanchion mounting the operator end piece; and (c) an engagement stanchion positioned on an opposed side of the roadway from the operator stanchion for selectably fastening the engagement end piece whenever the gate is in a closed position.

2. The crash barrier of claim 1, wherein the gate exhibits bilateral symmetry about a vertical transverse midplane and a horizontal longitudinal midplane.

3. The crash barrier of claim 1, wherein the operator stanchion comprises a head rotatably mounted on a mounting post and restrained against rotation about the mounting post by at least one shear pin.

4. The crash barrier of claim 1, wherein the engagement stanchion comprises a head rotatably mounted on a mounting post and restrained against rotation about the mounting post by at least one shear pin.

5. The crash barrier of claim 1, wherein the operator stanchion and the engagement stanchion each have a head rotatably mounted on a mounting post and each is restrained against rotation about the mounting post by at least one shear pin per mounting post.

6. The crash barrier of claim 1, wherein the operator stanchion and the engagement stanchion each have a head mounted on a mounting post and sealed against the infiltration of corrosive fluids.

7. The crash barrier of claim 1, wherein the gate has three cables.

8. The crash barrier of claim 1, wherein each tube tie substantially encircles the gate section.

9. The crash barrier of claim 1, wherein the tube ties are made of press-broken metal plate joined into continuous loops about the gate section.

10. The crash barrier of claim 1, wherein the operator end piece is mounted to a rotatable arm assembly of the operator stanchion.

11. The crash barrier of claim 10, wherein the arm assembly includes an adjustable counterweight assembly.

12. The crash barrier of claim 11, wherein the position of the counterweight assembly is adjustable in a vertical plane of the gate in both a vertical direction and a horizontal direction.

13. The crash baffler of claim 1 having at least two gate sections, wherein the cable tubes of the gate sections are aligned when the gate sections are connected.

14. The crash barrier of claim 13, wherein the gate has two outside gate sections separated by an inner gate section.

15. The crash barrier of claim 13, wherein at least two of the gate sections are substantially the same in size and construction.

16. The crash barrier of claim 1, further comprising a pair of wind stay cables extending from a first mounting point on a wind stay support arm mounted on the operator stanchion to a second mounting point on the gate.

17. The crash barrier of claim 16, wherein each wind stay cable crosses from one side of a gate midplane at the first mounting point to an opposed side of the gate midplane at the second mounting point.

18. The crash barrier of claim 17, wherein the second mounting points of the pair of wind stay cables are vertically offset from each other such that the mounted wind stay cables are vertically separated from each other at the top of the gate.

19. The crash barrier of claim 1, wherein the cables deform as a unit upon vehicular impact.

20. The crash barrier of claim 1, wherein the engagement end piece has a cross bar that is selectably secured in a detent in an anchorage plate attached to the engagement stanchion.

21. The crash barrier of claim 1, wherein the engagement end piece is secured by an anti-uplift latch mounted on the engagement stanchion.

22. The crash barrier of claim 1, wherein the engagement stanchion has a head having a gate anchorage assembly mounted thereon and wherein the gate anchorage assembly is mounted symmetrically about a vertical centerline plane transverse to the roadway.

23. The crash barrier of claim 22, wherein the anchorage assembly includes a guidance means for guiding the engagement end piece of the gate into the anchorage assembly.

24. The crash barrier of claim 23, wherein the guidance means comprises two vertical mirror image arm guide plates having an upwardly increasing gap between the two guide plates.

25. The crash barrier of claim 22, wherein the anchorage assembly comprises a pair of anchorage plates spaced apart sufficiently to admit the entry of the engagement end piece of the gate into an engagement detent in each of the anchorage plates, the ends of the engagement end piece being distal from the gate.

26. The crash barrier of claim 25, wherein the engagement detents are cut into an upper side of each anchorage plate to allow the engagement of a pair of symmetrically laterally extending ends of the engagement end piece of the gate by the engagement detents.

27. The crash barrier of claim 26, wherein the gate anchorage assembly includes a latch that engages at least one laterally extending end of the engagement end piece.

28. The crash barrier of claim 1, wherein the operator stanchion has a head having a gate anchorage assembly mounted thereon and wherein the gate anchorage assembly is mounted symmetrically about a vertical centerline plane of the gate.

29. The crash barrier of claim 28, wherein the anchorage assembly comprises a pair of anchorage plates spaced apart sufficiently to admit the entry of the operator end piece of the gate into an engagement detent in each of the anchorage plates, the ends of the operator end piece being distal from the gate.

30. The crash barrier of claim 29, wherein the engagement detents are cut into an upper side of each anchorage plate to allow the engagement of a pair of symmetrically laterally extending ends of the operator end piece of the gate by the engagement detents.

31. The crash barrier of claim 1, wherein the operator stanchion includes a support arm assembly, the support arm assembly including a shaft.

32. The crash barrier of claim 31, wherein the support arm assembly rotates about coaxial journals supporting the shaft.

33. The crash barrier of claim 1, wherein the operator stanchion includes a support arm assembly attached to the operator end piece at one end and supporting an adjustable counterweight assembly at a second end.

34. The crash barrier of claim 33, wherein the counterweight assembly is mounted on the support arm assembly about the vertical midplane of the gate.

35. The crash barrier of claim 33, wherein the counterweight assembly has at least one weight segment.

36. The crash barrier of claim 33, wherein the counterweight assembly has a counterweight mounting plate attached to the support arm assembly such that one or more weight segments can be selectably added to the counterweight assembly.

37. The crash barrier of claim 1, wherein the operator stanchion includes at least one wind stay support arm.

38. The crash barrier of claim 1, wherein the operator stanchion includes a rotatable support arm assembly affixed to the operator end piece of the gate.

39. The crash barrier of claim 38, wherein a pair of wind stay support arms are mounted on the support arm assembly, one wind stay support arm mounted on each side of the support arm assembly in close proximity to where the operator end piece of the gate is affixed to the arm support assembly.

40. The crash barrier of claim 1, wherein the operator stanchion includes a support arm assembly, the support arm assembly including a shaft, and an actuator that interacts with the shaft to selectably rotate the support arm assembly between an up position and a down position.

41. The crash barrier of claim 40, wherein the support arm assembly further includes a control box for selectably activating the actuator to rotate the support arm assembly.

42. The crash barrier of claim 1, wherein the cables have a swaged-on externally threaded cable end fitting on each end of the cable.

43. The crash barrier of claim 42, wherein for each cable the threaded cable end fittings interact with at least one cable-tensioning nut for adjusting a cable tension.

44. A crash barrier comprising:

(a) a gate having an operator gate end and an engagement gate end;

(b) an engagement stanchion positioned on one side of a roadway for selectably fastening the engagement gate end whenever the gate is closed, wherein the engagement stanchion comprises an engagement head rotatably mounted on an engagement mounting post and restrained from rotation about the engagement mounting post by at least one shear pin; and (c) an operator stanchion positioned on an opposed side of the roadway from the engagement stanchion for raising and lowering the gate, the operator stanchion attached to the operator gate end, wherein the operator stanchion comprises an operator head rotatably mounted on an operator mounting post and restrained from rotation about the operator mounting post by at least one shear pin.

45. A crash barrier comprising:

(a) a gate having a vertical midplane, an operator gate end, and an engagement gate end;

(b) an engagement stanchion positioned on one side of a roadway for selectably fastening the engagement gate end whenever the gate is closed; and (c) an operator stanchion positioned on an opposed side of the roadway from the engagement stanchion for raising and lowering the gate, the operator stanchion having a rotatable support arm assembly attached to the operator gate end at one end and supporting an adjustable counterweight assembly at a second end, the adjustable counterweight assembly comprising:

(i) at least one counterweight anchor point affixed to the support arm assembly, the counterweight anchor point having a through hole parallel to the support arm assembly adjacent the counterweight anchor point;

(ii) a counterweight mounting plate having at least one threaded rod attached to a front side of the counterweight mounting plate, wherein one threaded rod passes through each through hole whenever the counterweight mounting plate is mounted on the support arm assembly; and (iii) two threaded nuts threaded onto each threaded rod, one nut positioned on each side of the counterweigh anchor point where the threaded rod passes through the through hole;

whereby adjustment of the axial position of the nuts moves the counterweight mounting plate relative to the counterweight anchor points in a parallel direction to the support arm assembly adjacent the counterweight anchor point.

46. The crash barrier of claim 45, wherein the adjustable counterweight assembly further comprising:

(a) a suspender element affixed an upper side of the counterweight mounting plate, wherein the suspender element has at least one aperture transverse to the through hole in the counterweight anchor point, the aperture offset from a backside of the counterweight mounting plate;

(b) at least one counterweight plate positioned adjacent to the counterweight mounting plate and under the suspender element, each counterweight plate supported transverse to the vertical midplane of the gate by the support arm assembly, wherein a top side of each counterweight plate has a threaded hole coaxial with one aperture of the suspender element; and (c) threaded means for adjusting the counterweight plate position transverse to the arm assembly adjacent the counterweight assembly.

47. A crash barrier comprising:

(a) a gate having an operator gate end and an engagement gate end, the engagement gate end including a gate latchable member with a horizontal detent;

(b) an operator stanchion positioned on one side of a roadway for raising and lowering the gate; and (c) an engagement stanchion positioned on an opposed side of the roadway from the operator stanchion for selectably fastening the engagement gate end whenever the gate is closed, the engagement stanchion comprising a head having a gate anchorage assembly mounted thereon wherein the gate anchorage assembly includes:

(i) a pair of anchorage plates spaced apart sufficiently to admit entry of the engagement gate end between the anchorage plates, (ii) a guidance means for guiding the engagement gate end into the anchorage assembly, and (iii) a pivotable latch plate comprising:

(aa) a horizontal latching surface, (bb) a pivot point, (cc) a spring-biased means for urging the latching surface outwardly to engage the horizontal detent of the gate latchable member, and (dd) a latch release means for pivotably disengaging the latching surface from the horizontal detent of the gate latchable member, wherein the latch release means is selectably activated by a pull solenoid.

48. A crash barrier comprising:

(a) a gate, wherein the gate comprises:

(i) at least two gate sections, each gate section having:

(aa) a first and a second end, (bb) at least two vertical structures having a number of spaced apart apertures, the number and spacing of the apertures being substantially equal on the vertical structures and where one vertical structure is positioned at the first end of the gate section and the other vertical structure is positioned at the second end of the gate section, (cc) a number of cable tubes, wherein the number of tubes is equal to the number of apertures in the vertical structures, the cable tubes extending substantially horizontally between and attached to the vertical structures such that an interior of each cable tube is aligned with one aperture in each of the vertical structures, and (dd) a plurality of tube ties spaced apart along a length of the cable tubes, each tube tie attached to at least two sides of each cable tube, (ii) an operator end piece mounted at an operator gate end, (iii) an engagement end piece mounted at an engagement gate end, (iv) means for connecting the gate sections together such that the cable tube interiors and the apertures of the vertical structures are aligned along a length of the gate, and (v) a plurality of substantially parallel spaced apart extensible cables extending substantially horizontally from the operator end piece to the engagement end piece, wherein each cable is surrounded by one cable tube as the cable extends across each gate section and is anchored at a first cable end by the operator end piece and at a second cable end by the engagement end piece;

(b) an operator stanchion on one side of a roadway for raising and lowering the gate, the operator stanchion comprising:

(i) an operator head, (ii) an operator mounting post, wherein the operator head is rotatably mounted on the operator mounting post and restrained against rotation about the operator mounting post by at least one shear pin, (iii) an operator anchorage assembly symmetrically mounted on the operator head about a vertical centerline plane of the gate, (iv) a support arm assembly having a shaft journaled in the operator head, wherein the support arm assembly is rotatable about a pair of coaxial journals supporting the shaft, (v) an adjustable counterweight assembly supported by the support arm assembly, and (vi) means for attaching the operator end of the gate to the support arm assembly; and (c) an engagement stanchion positioned on an opposed side of the roadway from the operator stanchion for selectably fastening the gate in a closed position, the engagement stanchion comprising (i) an engagement head rotatably mounted on an engagement mounting post and restrained against rotation about the engagement mounting post by at least one shear pin, (ii) an engagement anchorage assembly symmetrically mounted on the engagement head about a vertical centerline plane traverse to the roadway, wherein the engagement anchorage assembly includes a pair of anchorage plates, spaced apart sufficiently to admit the entry of an outside end of the engagement end piece, and an anti-uplift latch.

49. The crash barrier of claim 48, wherein the means for attaching the operator end of the gate to the support arm assembly comprises at least one shear pin whereby when the shear pin is ruptured upon vehicular impact the operator end piece is engaged by the operator anchorage assembly.

* * * * *